US009183782B2

(12) United States Patent
Ono et al.

(10) Patent No.: US 9,183,782 B2
(45) Date of Patent: Nov. 10, 2015

(54) IMAGE DISPLAY DEVICE

(71) Applicant: JOLED INC., Tokyo (JP)

(72) Inventors: Shinya Ono, Osaka (JP); Kouhei Ebisuno, Kyoto (JP)

(73) Assignee: JOLED INC., Tokyo (JP)

( * ) Notice: Subject to any disclaimer, the term of this patent is extended or adjusted under 35 U.S.C. 154(b) by 413 days.

(21) Appl. No.: 13/792,782

(22) Filed: Mar. 11, 2013

(65) Prior Publication Data

US 2013/0187554 A1 Jul. 25, 2013

Related U.S. Application Data

(63) Continuation of application No. PCT/JP2011/004514, filed on Aug. 9, 2011.

(51) Int. Cl.
*G09G 3/30* (2006.01)
*G09G 3/32* (2006.01)

(52) U.S. Cl.
CPC ..... *G09G 3/3266* (2013.01); *G09G 3/3233* (2013.01); *G09G 2300/0819* (2013.01); *G09G 2300/0852* (2013.01); *G09G 2320/045* (2013.01)

(58) Field of Classification Search
CPC ..... G09G 3/3233; G09G 2310/0262; G09G 3/3266; G09G 2320/043; G09G 2320/0233; G09G 2300/0426; G09G 2300/0439; G09G 2330/021; H01L 27/3244
See application file for complete search history.

(56) References Cited

U.S. PATENT DOCUMENTS

| | | | |
|---|---|---|---|
| 7,274,345 | B2 | 9/2007 | Imamura et al. |
| 7,825,406 | B2 | 11/2010 | Yoshida et al. |
| 7,834,827 | B2 | 11/2010 | Miyake et al. |
| 7,969,394 | B2 | 6/2011 | Uchino et al. |
| 8,018,404 | B2 | 9/2011 | Ono |

(Continued)

FOREIGN PATENT DOCUMENTS

| | | |
|---|---|---|
| CN | 1728218 | 2/2006 |
| CN | 101266749 | 9/2008 |

(Continued)

OTHER PUBLICATIONS

U.S. Appl. No. 13/487,788 to Shinya Ono et al., filed Jun. 4, 2012.

(Continued)

*Primary Examiner* — Abbas Abdulselam
*Assistant Examiner* — Gerald Oliver
(74) *Attorney, Agent, or Firm* — Greenblum & Bernstein, P.L.C.

(57) ABSTRACT

An image display device includes: an organic EL element, a first electrostatic capacitor, a driving transistor having a gate connected to a first electrode of the first electrostatic capacitor and a source connected to an anode of the organic EL element, a second electrostatic capacitor having an electrode connected to a second electrode of the first electrostatic capacitor, a negative power source line which determines the potential of a cathode of the organic EL element, and a scanning line driving circuit which controls a first switching transistor, a second switching transistor, and a third switching transistor. In a non-light-emitting period, the scanning line driving circuit sets, during a period from a start of a reset period to an end of the non-light-emitting period, a fixed voltage corresponding to the potential of the negative power source line to the source electrode of the driving transistor.

22 Claims, 25 Drawing Sheets

(56) References Cited

U.S. PATENT DOCUMENTS

| | | | | |
|---|---|---|---|---|
| 8,248,331 | B2 | 8/2012 | Ono | |
| 8,294,701 | B2 | 10/2012 | Matsui et al. | |
| 8,300,038 | B2 | 10/2012 | Tomida et al. | |
| 8,599,178 | B2 | 12/2013 | Uchino et al. | |
| 8,624,807 | B2 | 1/2014 | Miyake et al. | |
| 8,749,454 | B2 | 6/2014 | Ono | |
| 8,803,768 | B2 * | 8/2014 | Kimura et al. | 345/76 |
| 8,830,218 | B2 | 9/2014 | Uchino et al. | |
| 9,024,929 | B2 | 5/2015 | Uchino et al. | |
| 2004/0196239 | A1 * | 10/2004 | Kwon | 345/92 |
| 2004/0257353 | A1 | 12/2004 | Imamura et al. | |
| 2006/0022900 | A1 | 2/2006 | Miyake et al. | |
| 2007/0128583 | A1 * | 6/2007 | Miyazawa | 434/433 |
| 2007/0296652 | A1 | 12/2007 | Imamura et al. | |
| 2008/0225025 | A1 | 9/2008 | Uchino et al. | |
| 2009/0278834 | A1 | 11/2009 | Tomida et al. | |
| 2010/0007645 | A1 | 1/2010 | Ono | |
| 2010/0110055 | A1 | 5/2010 | Ono | |
| 2010/0259531 | A1 | 10/2010 | Ono | |
| 2011/0057925 | A1 | 3/2011 | Miyake et al. | |
| 2011/0063275 | A1 | 3/2011 | Imamura et al. | |
| 2011/0141095 | A1 | 6/2011 | Matsui et al. | |
| 2011/0164024 | A1 | 7/2011 | Ono | |
| 2011/0193843 | A1 | 8/2011 | Uchino et al. | |
| 2011/0285760 | A1 | 11/2011 | Ono | |
| 2012/0001186 | A1 | 1/2012 | Kondoh et al. | |
| 2012/0049175 | A1 | 3/2012 | Ono et al. | |
| 2012/0147070 | A1 | 6/2012 | Segawa et al. | |
| 2012/0154460 | A1 | 6/2012 | Segawa et al. | |
| 2012/0154700 | A1 * | 6/2012 | Shin et al. | 349/42 |
| 2012/0169707 | A1 | 7/2012 | Ebisuno et al. | |
| 2014/0049530 | A1 | 2/2014 | Uchino et al. | |
| 2014/0347337 | A1 | 11/2014 | Uchino et al. | |

FOREIGN PATENT DOCUMENTS

| | | |
|---|---|---|
| CN | 101577085 | 11/2009 |
| CN | 101842829 | 9/2010 |
| CN | 102144252 | 8/2011 |
| JP | 2005-004173 | 1/2005 |
| WO | 2008/152817 | 12/2008 |
| WO | 2009/078166 | 6/2009 |
| WO | 2010/041426 | 4/2010 |

OTHER PUBLICATIONS

Office Action from State Intellectual Property Office of the People's Republic of China (SIPO) in Chinese Patent Application No. 201180039059.6, dated Jul. 14, 2015, together with a partial English language translation.

* cited by examiner

IMAGE DISPLAY DEVICE

CROSS REFERENCE TO RELATED APPLICATION

This is a continuation application of PCT Patent Application No. PCT/JP2011/004514 filed on Aug. 9, 2011, designating the United States of America. The entire disclosure of the above-identified application, including the specification, drawings and claims are incorporated herein by reference in its entirety.

FIELD

One or more exemplary embodiments disclosed herein relate generally to image display devices, and in particular, to an image display device using current-driven light-emitting elements.

BACKGROUND

Image display devices using organic electroluminescence (EL) elements are known as image display devices using current-driven light-emitting elements. Such organic EL display devices using organic EL elements which emit light are best suited to make thinner devices because such organic EL elements eliminate the necessity of back lights conventionally required for liquid crystal display devices. In addition, the organic EL elements do not place a limit on view angle, and thus are expected to be practically used as next-generation display devices. Furthermore, the organic EL elements used for the organic EL display devices include light-emitting elements whose luminance are controlled by currents having certain values, instead of including liquid crystal cells controlled by voltages applied thereto.

In a usual organic EL display device, organic EL elements which serve as pixels are arranged in a matrix. An organic EL display is called a passive-matrix organic EL display, in which organic EL elements are provided at intersections of row electrodes (scanning lines) and column electrodes (data lines) and voltages corresponding to data signals are applied between selected row electrodes and the column electrodes to drive the organic EL elements.

On the other hand, an organic EL display device is called an active-matrix organic EL display, in which (i) switching thin film transistors (TFTs) are provided at the intersections of scanning lines and data lines and connected with the gates of driving elements which receive data signals through the signal lines when the switching TFTs are turned on through selected scanning lines, and (ii) the organic EL elements are driven by the driving elements.

The organic EL elements, which are included in the passive-matrix organic EL display device and which are connected to selected row electrodes (scanning lines), emit light only until the selected row electrodes become unselected. In contrast, organic EL elements in the active-matrix organic EL display device can keep emitting light till subsequent scanning (or selection), by including driving TFTs for controlling current supplied to the organic EL elements by using voltages applied to the gate electrodes, and electrostatic capacitors for stably holding the gate voltages of the driving TFTs. Thus, there is no reduction in luminance of the display even when the number of scanning lines increases. Accordingly, the active-matrix organic EL display device is driven with a low voltage, thereby consuming less power.

Here, an application of the gate voltage causes stress on the driving TFT, which changes the state of the driving TFT into a stable state slightly different from the initial electrical characteristics (threshold voltage). More specifically, in a case where display patterns are different between a previous display period and a subsequent display period, different levels of voltages are applied to the gate voltage of the driving TFT; and thus, the stable state of the electrical characteristics of the driving TFT in the previous display period caused by the application of gate voltage is different from the stable state of the electrical characteristics of the driving TFT in the subsequent display period caused by the application of gate voltage different from the gate voltage applied in the previous display period. This causes display unevenness (a residual image) in which influence of the previous display period is displayed at the moment of switching from the previous display period into the subsequent display period, resulting in reduction in display quality.

In order to cope with this, for example, Patent Literature (PTL) 1 discloses a circuit configuration of pixel units in an active-matrix organic EL display device.

FIG. 15 is a circuit configuration diagram of a pixel unit in a conventional organic EL display device according to PTL1. A pixel unit 500 in FIG. 15 has a simple circuitry including: an organic EL element 505 having a cathode connected to a negative power source line (whose voltage value is denoted as VEE); an n-type thin film transistor (n-type TFT) 504 having a drain connected to a positive power source line (whose voltage value is denoted as VDD) and a source connected to an anode of the organic EL element 505; a capacitor element 503 which is connected between the gate and the source of the n-type TFT 504 and holds a gate voltage of the n-type TFT 504; a third switching element 509 for causing both the terminals of the organic EL element 505 to have approximately the same potential; a first switching element 501 which selectively applies a video signal from a signal line 506 to the gate of the n-type TFT 504; and a second switching element 502 for initializing (resetting) the gate potential of the n-type TFT 504 into a predetermined potential. The following describes light emitting operations performed by the pixel unit 500.

In this conventional technique, in order to initialize (reset) the n-type TFT 504, first, the second switching element 502 is turned on at the start of a frame period by a scanning signal supplied from the second scanning line 508, and a predetermined voltage VREF supplied from a reference power source line is applied to the gate of the n-type TFT 504 so as to prevent a current from flowing between the source and the drain of the n-type TFT 504.

Next, the second switching element 502 is turned off by a scanning signal supplied from the second scanning line 508.

Next, the first switching element 501 is turned on to apply a signal voltage supplied from the signal line 506 to the gate of the n-type TFT 504.

Next, the third switching element 509 is turned off to supply a signal current corresponding to the charge accumulated in the capacitor element 503 from the n-type TFT 504 to the organic EL element 505. At this time, the organic EL element 505 emits light.

CITATION LIST

Patent Literature

[PTL 1]
Japanese Patent Application Publication No. 2005-4173

SUMMARY

Technical Problem

However, in the circuit configuration of the pixel unit as above, even in a case where a voltage having the same value is accumulated in the capacitor element 503, a current having different value may flow into the n-type TFT 504 that is a driving transistor.

More specifically, for example, suppose a case where 0V is set to a first electrode (reference voltage side) of the capacitor element 503, the voltage supplied to a second electrode (the organic EL element 505 side) of the capacitor element 503 is increased from 3V to 6V, and the potential difference held by the capacitor element 503 is 6V. Suppose another case where the voltage supplied to the second electrode of the capacitor element 503 is decreased from 9V to 6V, and the potential difference held by the capacitor element 503 is 6V. In these two cases, the current values corresponding to the voltage values may be different. This stems from the fact that the voltage-current characteristics of the n-type TFT 504 serving as a driving transistor have so called transient response characteristics of threshold voltage. When the voltage-current characteristics of the driving transistor have transient response characteristics of the threshold voltage as described above, a current having a value greater than or smaller than a desired current value may flow according to the voltage applied between the gate and source electrodes of the driving transistor in a previous display period.

In a case where a current having a value greater than the desired current value flows, excessive amount of light is emitted. On the other hand, in a case where a current having a value smaller than the desired current value flows, insufficient amount of light is emitted.

One non-limiting and exemplary embodiment provides an image display device which reduces occurrence of residual images due to hysteresis characteristics of the driving transistors, with simple pixel circuits.

Solution to Problem

In one general aspect, the techniques disclosed here feature an image display device which includes: a light-emitting element; a first capacitor which holds a voltage; a driving transistor having a gate electrode connected to a first electrode of the first capacitor, and a source electrode connected to a first electrode of the light-emitting element, the driving transistor causing the light-emitting element to emit light by applying, to the light-emitting element, a drain current corresponding to the voltage held by the first capacitor; a second capacitor having a first electrode connected to a second electrode of the first capacitor; a first power source line connected to a drain electrode of the driving transistor, for determining a potential of the drain electrode of the driving transistor; a second power source line connected to a second electrode of the light-emitting element, for determining a potential of the second electrode of the light-emitting element; a third power source line connected to the first electrode of the first capacitor, for supplying a first reference voltage defining a voltage value of the first electrode of the first capacitor; a fourth power source line connected to a second electrode of the second capacitor, for supplying a second reference voltage defining a voltage value of the second electrode of the second capacitor; a data line for supplying a signal voltage to the second electrode of the first capacitor; a first switching element provided between the first electrode of the first capacitor and the third power source line, the first switching element setting the first reference voltage to the first electrode of the first capacitor; a second switching element having two terminals one of which is electrically connected to the data line and the other of which is electrically connected to the second electrode of the first capacitor, the second switching element switching between a conducting state and a non-conducting state between the data line and the second electrode of the first capacitor; a third switching element provided between the first electrode of the light-emitting element and the second electrode of the first capacitor, the third switching element switching between a conducting state and a non-conducting state between the first electrode of the light-emitting element and the second electrode of the first capacitor; a driving circuit which controls the first switching element, the second switching element, and the third switching element; a first scanning line connected to the first switching element, the second switching element, and the driving circuit; and a second scanning line connected to the third switching element and the driving circuit. At a start of a reset period in a non-light-emitting period during which the third switching element is non-conducting, the driving circuit starts (i) setting a data voltage from the data line to the second electrode of the first capacitor, (ii) setting the first reference voltage from the third power source line to the first electrode of the first capacitor and the gate electrode of the driving transistor, and (iii) setting a fixed voltage corresponding to a potential of the second power source line to the source electrode of the driving transistor, the start of the reset period being a time at which the first switching element and the second switching element are made conducting by applying an on-voltage to the first scanning line; in the non-light-emitting period after making the first switching element and the second switching element non-conducting by applying an off-voltage to the first scanning line, the fixed voltage corresponding to the potential of the second power source line is set to the source electrode of the driving transistor; and in a light-emitting period, the driving circuit causes the light-emitting element to emit light, by applying a potential difference between the first electrode and the second electrode of the first capacitor, between the gate electrode and the source electrode of the driving transistor to cause a current to flow between the drain electrode and the source electrode of the driving transistor according to a potential difference between the gate electrode and the source electrode of the driving transistor, the light-emitting period being a period during which the first switching element and the second switching element are non-conducting and the third switching element is conducting made via the second scanning line.

Additional benefits and advantages of the disclosed embodiments will be apparent from the Specification and Drawings. The benefits and/or advantages may be individually obtained by the various embodiments and features of the Specification and Drawings, which need not all be provided in order to obtain one or more of such benefits and/or advantages.

Advantageous Effects

One or more exemplary embodiments or features disclosed herein provide an image display device which reduces occurrence of residual images due to hysteresis characteristics of driving transistors, with simple pixel circuits.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENTS

Figure 1:
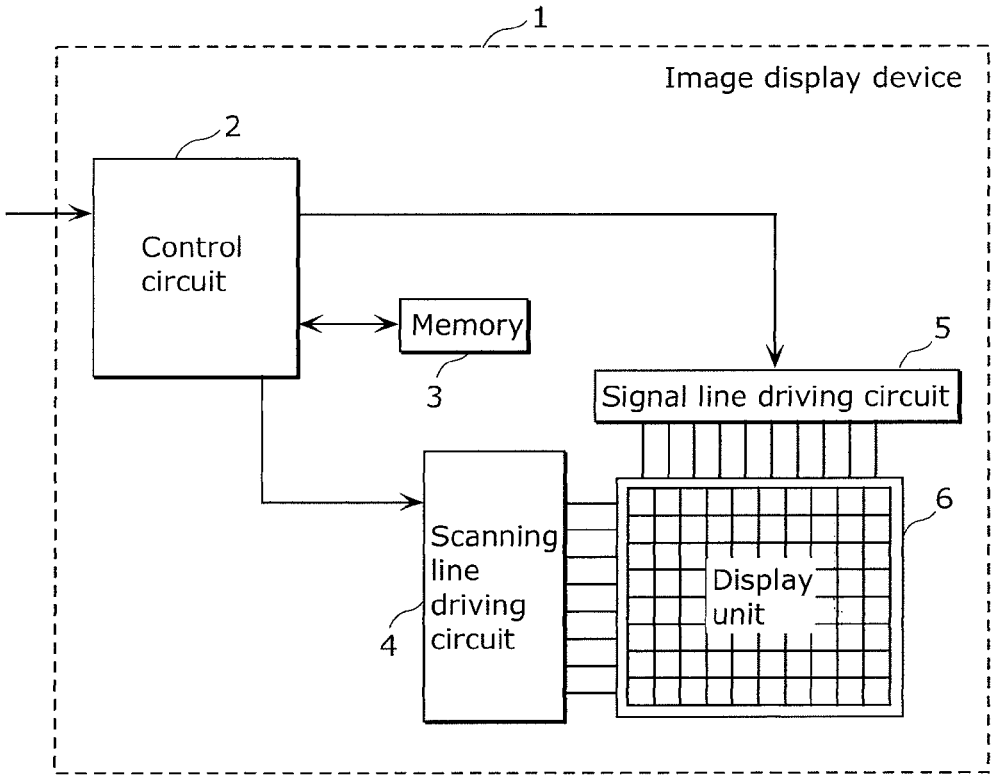
FIG. 1 is a block diagram showing an electrical configuration of an image display device according to the present disclosure.

According to an exemplary embodiment disclosed herein, a display device includes: a light-emitting element; a first capacitor which holds a voltage; a driving transistor having a gate electrode connected to a first electrode of the first capacitor, and a source electrode connected to a first electrode of the light-emitting element, the driving transistor causing the light-emitting element to emit light by applying, to the light-emitting element, a drain current corresponding to the voltage held by the first capacitor; a second capacitor having a first electrode connected to a second electrode of the first capacitor; a first power source line connected to a drain electrode of the driving transistor, for determining a potential of the drain electrode of the driving transistor; a second power source line connected to a second electrode of the light-emitting element, for determining a potential of the second electrode of the light-emitting element; a third power source line connected to the first electrode of the first capacitor, for supplying a first reference voltage defining a voltage value of the first electrode of the first capacitor; a fourth power source line connected to a second electrode of the second capacitor, for supplying a second reference voltage defining a voltage value of the second electrode of the second capacitor; a data line for supplying a signal voltage to the second electrode of the first capacitor; a first switching element provided between the first electrode of the first capacitor and the third power source line, the first switching element setting the first reference voltage to the first electrode of the first capacitor; a second switching element having two terminals one of which is electrically connected to the data line and the other of which is electrically connected to the second electrode of the first capacitor, the second switching element switching between a conducting state and a non-conducting state between the data line and the second electrode of the first capacitor; a third switching element provided between the first electrode of the light-emitting element and the second electrode of the first capacitor, the third switching element switching between a conducting state and a non-conducting state between the first electrode of the light-emitting element and the second electrode of the first capacitor; a driving circuit which controls the first switching element, the second switching element, and the third switching element; a first scanning line connected to the first switching element, the second switching element, and the driving circuit; and a second scanning line connected to the third switching element and the driving circuit. At a start of a reset period in a non-light-emitting period during which the third switching element is non-conducting, the driving circuit starts (i) setting a data voltage from the data line to the second electrode of the first capacitor, (ii) setting the first reference voltage from the third power source line to the first electrode of the first capacitor and the gate electrode of the driving transistor, and (iii) setting a fixed voltage corresponding to a potential of the second power source line to the source electrode of the driving transistor, the start of the reset period being a time at which the first switching element and the second switching element are made conducting by applying an on-voltage to the first scanning line; in the non-light-emitting period after making the first switching element and the second switching element non-conducting by applying an off-voltage to the first scanning line, the fixed voltage corresponding to the potential of the second power source line is set to the source electrode of the driving transistor; and in a light-emitting period, the driving circuit causes the light-emitting element to emit light, by applying a potential difference between the first electrode and the second electrode of the first capacitor, between the gate electrode and the source electrode of the driving transistor to cause a current to flow between the drain electrode and the source electrode of the driving transistor according to a potential difference between the gate electrode and the source electrode of the driving transistor, the light-emitting period being a period during which the first switching element and the second switching element are non-conducting and the third switching element is conducting made via the second scanning line.

According to the embodiment, the first switching element and the second switching element are controlled through a common first scanning line.

More specifically, the first switching element and the second switching element are made conducting through the first scanning line, while the third switching element is non-conducting.

First, a data voltage is set to the second electrode of the first capacitor from the data line, and the reference voltage is set to the first electrode of the first capacitor from the third power source line. Then, the first capacitor holds a voltage corresponding to the potential difference between the data voltage and the reference voltage. At the same time, the reference voltage is set to the gate electrode of the driving transistor from the third power source line. In this case, since the third switching element is non-conducting, the potential of the second electrode of the light-emitting element is set to the source electrode of the driving transistor. Accordingly, unnecessary charges accumulated in the driving transistor in the light-emitting period of the previous frame, starts to discharge (rest of the driving transistor starts). In other words, variation in the threshold voltage caused due to the charges accumulated in the driving transistor in the light-emitting period of the previous frame is eliminated, and the reset operation stables the threshold voltage of the driving transistor. Accordingly, when the reset is completed, the electrical characteristics of the driving transistor at the start of light emission are not influenced by the previous frame; and thus, it is possible to supply a current having a desired value to a light-emitting element.

Hence, the first capacitor holds the voltage corresponding to the potential difference between the data voltage and the reference voltage, and at the same time, the reset of the driving transistor starts. Thus, for one light emission of one pixel, the data line is not occupied for the length of time corresponding to two data writes. As a result, only one write is necessary for each pixel in a row. This means that double write speed is not necessary for completing write operations on all of the rows in one frame period. This eliminates the necessity of reduction in wiring time constant of the data lines, and also the necessity of thickening wiring films or insulating films for wiring, thereby reducing process time, increasing throughput, and reducing cost.

Next, the first switching element and the second switching element are made non-conducting, while the third switching element is non-conducting. During this process, the reset of the driving transistor continues. The longer this period is, the closer the potential of the source electrode of the driving transistor becomes to the fixed voltage corresponding to the reference voltage.

Here, even after the first switching element and the second switching element are switched from on to off and made non-conducting, the second capacitor reduces variation in the potential held by the first capacitor. Hence, even when the first switching element and the second switching element are made non-conducting, the potential held by the first capacitor can be maintained.

Next, the third switching element is made conducting, while the first switching element and the second switching element are non-conducting. Accordingly, the gate and the source of the driving transistor are connected, the potential of the first electrode of the first capacitor is set to the gate of the driving transistor, and the potential of the second electrode of the first capacitor is set to the source of the driving transistor. In other words, the potential difference between the first electrode and the second electrode of the first capacitor is applied between the gate electrode and the source electrode of the driving transistor. As a result, the light-emitting element emits light when a current flows between the drain and the source of the driving transistor according to the potential difference between the gate electrode and the source electrode of the driving transistor.

As described, the control by the first scanning line sets the data voltage to the second electrode of the first capacitor and also starts reset of the driving transistor.

Furthermore, if the start of light emission of the light-emitting element is delayed by the control through the second control line, the length of time period for resetting the driving transistor can be provided longer.

As a result, with a simple configuration in which the first switching element and the second switching element are controlled by a common first scanning line, influences of hysteresis can be reduced by a simple control which sets the data voltage to the second electrode of the first capacitor and also starts the reset operation of the driving transistor, and another simple control which starts light emission of the light-emitting element and which ends the reset operation of the driving transistor.

Here, it may be that in the non-light-emitting period, a reverse bias is applied to the driving transistor by applying the fixed voltage corresponding to the potential of the second power source line and the first reference voltage.

With this, in a case where the first switching element and the second switching element are made conducting through the first scanning line while the third switching element is non-conducting, a decrease in the potential difference between the gate and the source of the driving transistor securely starts.

Furthermore, it may be that a potential difference between the second power source line and the first electrode of the first capacitor to which the first reference voltage is set is less than or equal to a sum of an absolute value of a threshold voltage of the driving transistor and a threshold voltage for light emission of the light-emitting element.

Furthermore, it may be that the fixed voltage corresponding to the first reference voltage is a potential determined based on electrical characteristics of the driving transistor, electric characteristics of the light-emitting element, and the first reference voltage.

According to the embodiment, the fixed voltage corresponding to the reference voltage is determined based on the electrical characteristics of the driving transistor, electrical characteristics of the light-emitting element, and the reference voltage.

Furthermore, it may be that when changing the first switching element and the second switching element from conducting into non-conducting via the first scanning line, the driving circuit applies an overdrive voltage that is a voltage lower than the off-voltage to the gate electrode of the first switching element and the gate electrode of the second switching element, and then applies the off-voltage to the gate electrode of the first switching element and the gate electrode of the second switching element.

Signal transmission delay of a scanning line is defined by wiring resistance of the scanning line itself, and capacitance formed between the scanning line and an other control line or a power source line. As a result, when the output of the control circuit which controls the scanning line is changed from an on-voltage to an off-voltage, the potential at a point, which is farthest from the output terminal and is mostly influenced by wiring delays, asymptotically approaches the off-voltage with a given time constant.

There is a threshold voltage of the scanning line at which the first switching element and the second switching elements turned off, and this threshold voltage is referred to as Vgth. It is defined that t21 denotes the length of time required for the scanning line to change from an on-voltage to Vgth, t22 denotes the length of time required for the data line to change from the first data potential to the second data potential, and t23 denotes the length of time required for the data potential to equal the pixel potential, and t1H denotes the length of one horizontal period. Here, the potential of the data line cannot be changed till the potential of the scanning line at a point farthest from the output terminal of the scanning line driving circuit becomes lower than Vgth. Hence, an approximative relation of "t1H≥t21+t22+t23" exists.

In this embodiment, the scanning line is changed from an on-voltage to an overdrive voltage that is lower than the off-voltage, and then changed into the off-voltage (overdrive). Accordingly, the on-voltage of the scanning line tries to approximate the overdrive voltage; and thus, t1 can be reduced compared to the case where the scanning line is directly changed from an on-voltage into an off-voltage. In other words, the minimum value of t1H can be reduced. More specifically, the length of one frame period can be reduced because one frame period corresponds to t1H×(vertical synchronous frequency). As a result, the frame frequency of display can be increased.

Furthermore, it may be that a length of a period during which the overdrive voltage is applied to the gate electrode of the first switching element and the gate electrode of the second switching element is shorter than a length of a period during which the on-voltage is applied to the gate electrode of the first switching element and the gate electrode of the second switching element.

If the length of the period (overdrive period) during which the overdrive voltage is applied to the gate electrode of the first switching element and the gate electrode of the second switching element increases, off-characteristics of the first switching element and the second switching element decrease, thereby causing leak current.

According to the embodiment, the overdrive period is set shorter than the period during which the on-voltage is applied to the gate electrode of the first switching element and the gate electrode of the second switching element. Accordingly, the voltages of the gate electrode of the first switching element and the gate electrode of the second switching element are changed back to the off-voltage before they reach the level at which leak current occurs; and thus, leak current can be prevented while reducing the time t1 required for the first switching element and the second switching element to change from the on-voltage to the threshold voltage Vgth.

Furthermore, it may be that the non-light-emitting period is 25 percent or more of a single frame period that is a period from when the first switching element and the second switching element are made conducting to when the first switching element and the second switching element are made conducting in a subsequent non-luminescence period.

According to the embodiment, the period, during which the first switching element and the second switching element are made non-conducting while the third switching element is non-conducting, can be sufficiently provided. Accordingly, while the potential of the source electrode of the driving transistor is made approximate the fixed voltage corresponding to the reference voltage, the reset of the driving transistor can be continued.

Furthermore, it may be that the driving transistor includes a semiconductor layer which includes a crystalline silicon layer obtained by laser annealing an amorphous silicon film for crystallization.

With respect to this type of driving transistor, the potential of the source electrode of the driving transistor can be sufficiently made approximate the fixed voltage corresponding to the reference voltage, if the non-light-emitting period is 25 percent or more of the one frame period.

Furthermore, it may be that the first scanning line is provided outside a single pixel region which includes the first capacitor, the driving transistor, the second capacitor, the first switching element, the second switching element, and the third switching element.

An important function of the first switching element after the first scanning line is changed from the on-voltage into the off-voltage is to stably hold the gate voltage of the driving transistor together with the first capacitor without causing leak current. On the other hand, an important function of the second switching element is to stably hold the data voltage held by the first capacitor together with the first capacitor without causing leak current, and to stably hold the data voltage held by the second capacitor together with the second capacitor during the reset period.

Since the first scanning line is a control line fed from outside the display unit, the first scanning line has properties to easily pick up electrical noise from outside and prevent the functions of the first switching element and the second switching element when the potential varies due to the noise during a write period from the end of the previous light emission to the start of the current light emission.

If the variation in potential caused due to the noise influences the pixel, the voltage held by the first capacitor or the voltage held by the second capacitor may also vary. In particular, the first capacitor or the second capacitor is likely to be influenced, because the first capacitor and the second capacitor are likely to be unstable, if, as in this embodiment, a period is provided during which the first switching element and the second switching element are made non-conducting via the first scanning line and the third switching element is made non-conducting via the second scanning line.

Hence, in this embodiment, the first scanning line is provided outside the layout region of the pixel. Accordingly, even if the potential of the first scanning line varies, it is possible to reduce the possibility that this variation influences the pixel. As a result, it is possible to reduce the possibility that the voltage held by the first capacitor varies.

Furthermore, it may be that the second scanning line passes within the single pixel region.

In such a manner, as one embodiment, the second control line may be provided within the layout region of the pixel.

Furthermore, it may be that the third power source line is provided outside the single pixel region, and the first scanning line is provided on a contact region which is for electrically connecting the third power source line and the driving transistor.

In such a manner, as one embodiment, the first scanning line may be provided on a contact region of the third power source line outside the pixel and the first transistor within the pixel.

Furthermore, it may be that the second scanning line is provided outside a single pixel region which includes the first capacitor, the driving transistor, the second capacitor, the first switching element, the second switching element, and the third switching element.

Furthermore, it may be that the second scanning line is provided on a node where the source electrode of the driving transistor and the luminescence element are connected and a node where the second switching element and the third switching element are connected.

In such a manner, as one embodiment, the second scanning line may be provided on the node (s) between the source electrode of the driving transistor and the light-emitting element and the node (a) between the second switching element and the third switching element.

Furthermore, it may be that the second electrode of the second capacitor, a first node, and a second node are overlapped in this order in a vertical direction relative to the first power source line, the first node extending a source electrode of the second switching element and a source electrode of the third switching element, and the second node extending the gate electrode of the driving transistor.

According to this embodiment, the element placement region can be reduced.

Furthermore, it may be that in a region where the second electrode of the second capacitor, the first node, and the second node are overlapped in this order in the vertical direction, the second node has a width smaller than a width of the first node.

According to the embodiment, in a region where no node exists, the first power source line and the gate node are not overlapped. If the first power source line and the gate node are overlapped in the region where no node exists, parasitic capacitance is generated between the first power source line and the gate node. On the other hand, the capacitance between the first power source line and the node and the capacitance between the node and the gate node are necessary capacitance.

These capacitances reduce occurrence of the parasitic capacitance.

Furthermore, it may be that the first capacitor includes the second node, a first insulating film, and the first node, and the second capacitor includes the second electrode, a second insulating film, and the first node.

Furthermore, it may be that the second electrode of the second capacitor is included in a part of one of the first power source line, the second power source line and the third power source line.

Furthermore, it may be that a wiring layer immediately above the second insulating film is thicker than the first electrode or the second electrode of the first capacitor.

According to the embodiment, the thickness of the first power source line and the scanning line that are formed in the wiring layer immediately above the second insulating film are greater than the thickness of the first electrode or the second electrode of the first capacitor. Accordingly, the wiring resistance of the first power source line and the scanning line can be reduced. Hence, it is possible to further stabilize display quality, by reducing voltage drop of the first power source line to stably supply power to the driving transistor or reducing the wiring time constant of the scanning line.

Furthermore, it may be that a wiring layer immediately above the second insulating film includes at least two layers, and at least one of the at least two layers forms the second electrode of the second capacitor.

According to the embodiment, the wiring layer immediately above the second insulating film may include at least two layers.

Furthermore, it may be that a wiring layer immediately above the second insulating film includes a plurality of layers, an uppermost layer of the wiring layer is thickest among the plurality of layers, and the plurality of layers excluding the uppermost layer form the second electrode of the second capacitor.

According to the embodiment, the wiring layer immediately above the second insulating film includes a plurality of layers. The uppermost layer of the wiring layer is thickest, and is not formed in the region of the second capacitor. With this, forming the first power source line and the scanning line so as to include the uppermost layer of the wiring layer immediately above the second insulating film reduces wiring resistance, and also allows thinner second electrode of the second capacitor, thereby reducing the overall thickness of the second capacitor. As a result, it is possible to improve flatness above the formation area of the second capacitor, while reducing the wiring resistance of the first power source line and the first scanning line.

Furthermore, it may be that a wiring layer immediately above the second insulating film includes a plurality of layers, a lowermost layer of the wiring layer is thickest among the plurality of layers, and the plurality of layers excluding the lowermost layer form the second electrode of the second capacitor.

According to the embodiment, the wiring layer immediately above the second insulating film includes a plurality of layers. The lowermost layer of the first power source line and the scanning line that are the wiring layers is thickest, and the lowermost layer of the first power source line is not formed in the region of the second capacitor. With this, it is possible to reduce the wiring resistance of the first power source line and the first scanning line, and also allows thinner second electrode of the second capacitor, thereby reducing the overall thickness of the second capacitor. As a result, it is possible to improve flatness above the formation area of the second capacitor, while reducing the wiring resistance of the first power source line.

Furthermore, it may be that the second electrode of the second capacitor is connected to one of the first power source line, the second power source line, the third power source line, the source of the driving transistor, and the second scanning line.

According to the embodiment, it is not necessary to prepare a power source line or a power source for determining the potential of the second electrode of the second capacitor, thereby simplifying the pixel arrangement and driving circuit.

Any wiring may be used as long as the wiring is capable of supplying a constant potential to the second electrode of the second capacitor.

Each of the exemplary embodiments described below shows a general or specific example. The numerical values, shapes, materials, structural elements, the arrangement and connection of the structural elements, steps, the processing order of the steps etc. shown in the following exemplary embodiments are mere examples, and therefore do not limit the scope of the appended Claims and their equivalents. Therefore, among the structural elements in the following exemplary embodiments, structural elements not recited in any one of the independent claims are described as arbitrary structural elements.

Embodiment 1

Hereinafter, certain exemplary embodiments are described in greater detail with reference to the accompanying Drawings.

FIG. 1 is a block diagram showing an electrical configuration of an image display device according to the present disclosure. An image display device 1 in FIG. 1 includes a control circuit 2, a memory 3, a scanning line driving circuit 4, a signal line driving circuit 5, and a display unit 6.

Figure 2:
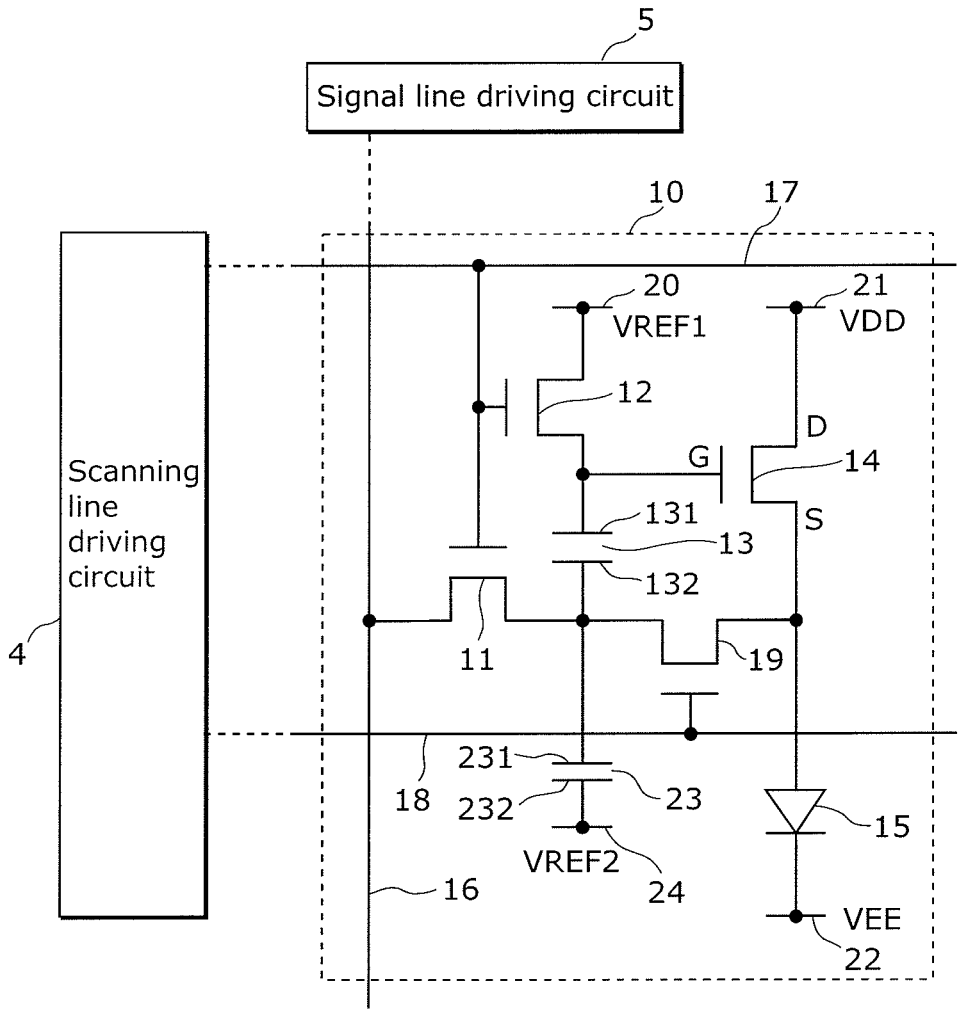
FIG. 2 is a diagram showing a circuit configuration of a light-emitting pixel included in a display unit and connections with the surrounding circuits according to Embodiment 1.

FIG. 2 is a diagram showing a circuit configuration of a light-emitting pixel included in a display unit and connections with the surrounding circuits according to Embodiment 1. A light-emitting pixel 10 in FIG. 2 includes switching transistors 11, 12, and 19, electrostatic capacitors 13 and 23, a driving transistor 14, an organic EL element 15, a signal line 16, scanning lines 17 and 18, reference power source lines 20 and 24, a positive power source line 21, and a negative power source line 22. In addition, the surrounding circuits include the scanning line driving circuit 4 and the signal line driving circuit 5.

The circuit configuration shown in FIG. 2 is the same as that disclosed in WO2010/041426.

The following descriptions are given of connection relationships and functions of the structural elements shown in FIG. 1 and FIG. 2.

The control circuit 2 controls the scanning line driving circuit 4, the signal line driving circuit 5, and the memory 3. The memory 3 stores correction data or the like of the respective light-emitting pixels. The control circuit 2 reads the correction data written in the memory 3, corrects a video signal inputted from outside, based on the correction data, and outputs the corrected data to the signal line driving circuit 5.

The scanning line driving circuit 4 is an example of the driving circuit according to the present disclosure. The scanning line driving circuit 4 controls the switching transistors 11, 12, and 19. More specifically, the scanning line driving circuit 4 is connected to the scanning lines 17 and 18, and controls between conducting and non-conducting states of the switching transistors 11, 12, and 19 included in the light-emitting pixel 10 by outputting a scanning signal to the scanning lines 17 and 18.

The signal line driving circuit 5 is connected to the signal line 16, and functions as a driving circuit for outputting a signal voltage based on a video signal to the light-emitting pixel 10.

The display unit 6 includes light-emitting pixels 10, and displays an image, based on the video signal inputted from outside to the image display device 1.

The switching transistor 11 is an example of the second switching element according to the present disclosure. The switching transistor 11 has one terminal electrically connected to the signal line 16, and another terminal electrically connected to an electrode 132 of the electrostatic capacitor 13. The switching transistor 11 switches between conducting and non-conducting states between the signal line 16 and the electrostatic capacitor 13. More specifically, the switching transistor 11 is a second switching element having a gate connected to the scanning line 17, a source and a drain one of which is connected to the signal line 16 and the other of which is connected to the electrode 132 of the electrostatic capacitor 13. The switching transistor 11 determines the voltage held between the electrodes of the electrostatic capacitor 13 by controlling the conducting and non-conducting states between the signal line 16 and the electrode 132 of the electrostatic capacitor 13.

The switching transistor 12 is an example of the first switching element according to the present disclosure. The switching transistor 12 is provided between an electrode 131 of the electrostatic capacitor 13 and the reference power source line 20, and sets the reference voltage to the electrode 131 of the electrostatic capacitor 13. More specifically, the switching transistor 12 is a first switching element having a gate connected to the scanning line 17, and has a source and a drain one of which is connected to the reference power source line 20 and the other of which is connected to the electrode 131 of the electrostatic capacitor 13. The switching transistor 12 determines a timing with which reference voltage VREF1 of the reference power source line 20 is applied to the electrode 131 of the electrostatic capacitor 13. The switching transistors 11 and 12 are configured, for example, in form of n-type thin film transistors (n-type TFTs), but may be p-type thin film transistors (p-type TFTs).

The electrostatic capacitor 13 is an example of the first capacitor according to the present disclosure. The electrostatic capacitor 13 has a first electrode and a second electrode, and holds voltage. More specifically, the electrostatic capacitor 13 is a first capacitor having the electrode 131 that is the first electrode connected to the gate of the driving transistor 14, and having the electrode 132 that is the second electrode connected to the source of the driving transistor 14 through the switching transistor 19. The electrostatic capacitor 13 holds the voltage corresponding to the signal voltage supplied from the signal line 16. For example, after the switching transistors 11 and 12 are turned off (made non-conducting) and the switching transistor 19 is turned on (made conducting), the electrostatic capacitor 13 stably holds the potential between the gate electrode and the source electrode of the driving transistor 14 and stabilizes a current supplied from the driving transistor 14 to the organic EL element 15.

The electrostatic capacitor 23 is an example of the second capacitor according to the present disclosure. The electrostatic capacitor 23 has a first electrode connected to the electrode 132 of the electrostatic capacitor 13. More specifically, the electrostatic capacitor 23 is a second capacitor having an electrode 231, that is a first electrode connected to the electrode 132 of the electrostatic capacitor 13, and having an electrode 232 that is a second electrode connected to the reference power source line 24 that is the first reference power source line. Since the electrode 232 of the electrostatic capacitor 23 is connected to the fixed reference voltage VREF2 of the reference power source line 24, the electrostatic capacitor 23 reduces, with the electrostatic capacitors 13, variation in the potential VREF1 held by the first electrode 131 of the electrostatic capacitors 13, even after the switching transistors 11 and 12 are switched from on (conducting state) into off (non-conducting state). More specifically, even when the switching transistors 11 and 12 are turned off (made non-conducting), the electrostatic capacitor 23 stably keeps the voltage applied to the gate electrode of the driving transistor 14 VREF1.

The driving transistor 14 is an example of the light-emitting element according to the present disclosure. The driving transistor 14 has a gate connected to the electrode 131 of the electrostatic capacitor 13, and a source connected to an anode of the organic EL element 15. The driving transistor 14 supplies, to the organic EL element 15, a drain current corresponding to the voltage held by the electrostatic capacitor 13 to cause the organic EL element 15 to emit light. More specifically, the driving transistor 14 is a driving element having a drain connected to the positive power source line 21 that is the second power source line, and having a source connected to the anode of the organic EL element 15. The driving transistor 14 converts the voltage corresponding to the signal voltage applied between the gate and the source into a drain current corresponding to the signal voltage. Subsequently, the driving transistor 14 supplies this drain current as the signal current to the organic EL element 15. The driving transistor 14 is configured in form of n-type thin film transistor (n-type TFT), for example. Furthermore, the driving transistor 14 may include a semiconductor layer including (i) an amorphous silicon film or (ii) a crystalline silicon layer obtained by laser annealing an amorphous silicon film for crystallization, or may include a semiconductor layer comprising an oxide of alloy including, for example, In or Zn.

The organic EL element 15 is an example of a light-emitting element according to the present disclosure. More specifically, the organic EL element 15 is a light-emitting element having a cathode connected to the negative power source line 22 that is the second power source line. The organic EL element 15 emits light when the signal current controlled by the driving transistor 14 flows into the organic EL element 15.

The switching transistor 19 is an example of the third switching element according to the present disclosure. The switching transistor 19 is provided between the anode of the organic EL element 15 and the electrode 132 of the electrostatic capacitor 13, and switches between conducting and non-conducting states between the anode of the organic EL element 15 and the electrode 132 of the electrostatic capacitor 13. More specifically, the switching transistor 19 is the third switching element which has a gate connected to the scanning line 18, and has a source and a drain one of which is connected to the source of the driving transistor 14 and the other of which is connected to the electrode 132 of the electrostatic capacitor 13. The switching transistor 19 determines a timing with which the potential held by the electrostatic capacitor 13 is applied between the gate electrode and the source electrode of the driving transistor 14 to cause the organic EL element 15 to start emitting light. The switching transistor 19 is configured in form of n-type thin film transistor (n-type TFT), for example. The switching transistor 19 may be configured in form of p-type thin film transistor (p-type TFT).

The signal line 16 is an example of the data line according: to the present disclosure, and supplies a signal voltage to the electrode 132 of the electrostatic capacitor 13. More specifically, the signal line 16 is connected to the signal line driving circuit 5 and to each of light-emitting pixels belonging to a pixel column including the light-emitting pixel 10, and supplies a signal voltage that determines the luminance intensity of the pixels. Here, the signal line 16 is provided for each pixel column. In other words, in the image display device 1, the number of signal lines 16 corresponds to the number of pixel columns.

The scanning line 17 is an example of the first scanning line according to the present disclosure. The scanning line 17 is connected to the switching transistors 11 and 12, and the scanning line driving circuit 4. Mores specifically, the scanning line 17 is connected to the scanning line driving circuit 4, and is also connected to each of the light-emitting pixels belonging to the pixel row including the light-emitting pixel 10. With this, the scanning line 17 supplies a timing with which the signal voltage is written into each of the light-emitting pixels belonging to the pixel row including the light-emitting pixel 10, and also supplies a timing with which the reference voltage VREF1 is applied to the gate of the driving transistor 14 included in the light-emitting pixel to end light emission of the organic EL element 15.

The scanning line 18 is an example of the second scanning line according to the present disclosure, and is connected to the switching transistor 19 and the scanning line driving circuit 4. More specifically, the scanning line 18 is connected to the scanning line driving circuit 4, and connects the potential of the electrode 132 of the electrostatic capacitor 13 to the source of the driving transistor 14. With this, the scanning line 18 supplies a timing with which the luminance signal voltage held between the electrodes of the electrostatic capacitor 13 is applied between the gate electrode and the source electrode of the driving transistor 14 to start light emission of the organic EL element 15.

Furthermore, in the image display device 1, the number of scanning lines 17 and 18 corresponds to the number of pixel rows.

The reference power source line 20 is an example of the third power source line according to the present disclosure. The reference power source line 20 is connected to the electrode 131 of the electrostatic capacitor 13, and supplies reference voltage VREF1 which defines the voltage value of the electrode 131 of the electrostatic capacitor 13. The VREF1 is set to the voltage at which the driving transistor 14 turns off.

The reference power source line 24 is an example of the fourth power source line according to the present disclosure. The reference power source line 24 is connected to the electrode 232 of the electrostatic capacitor 23, and supplies reference voltage VREF2 which defines the voltage value of the electrode 232 of the electrostatic capacitor 23. Furthermore, it is sufficient that the voltage of the gate electrode of the driving transistor 14 is stably kept from the time immediately before the switching transistors 11 and 12 are made conducting via the scanning line 17 till the time immediately before the switching transistor 19 is made conducting via the scanning line 18. For example, the reference power source line 24 may receive power from an independent line, or may be the positive power source line 21, the negative power source line 22, the reference power source line 20 or the scanning line 18 of each light-emitting pixel 10.

Furthermore, the positive power source line 21 is an example of the first power source line according to the present disclosure. The positive power source line 21 is connected to the drain of the driving transistor 14, and determines the potential (VDD) of the drain of the driving transistor 14.

The negative power source line 22 is an example of the second power source line according to the present disclosure. The negative power source line 22 is connected to the cathode of the organic EL element 15, and determines the potential (VEE) of the cathode of the organic EL element 15.

The image display device 1 has the configuration as described above.

Although not shown in FIGS. 1 and 2, each of the reference power source line 20, the reference power source line 24, the positive power source line 21 that is the first power source line, and the negative power source line 22 that is the second power source line is also connected to other light-emitting pixels and the voltage source.

Furthermore, it has been described that the electrode 232 of the electrostatic capacitor 23 is connected to the reference power source line 24; but the connection of the electrode 232 of the electrostatic capacitor 23 is not limited to this. It is sufficient that a constant potential is supplied to the electrode 232 of the electrostatic capacitor 23 during a non-light-emitting period. Accordingly, the electrode 232 of the electrostatic capacitor 23 may be connected to one of the positive power source line 21, the negative power source line 22, the reference power source line 20, the source of the driving transistor 14, and the scanning line 18. In this case, it is not necessary to prepare a power source line and a power source for determining the electrode 232 of the electrostatic capacitor 23, thereby simplifying the pixel arrangement and driving circuit.

Next, a description is given of a method of controlling the image display device 1 according to Embodiment 1.

Figure 3A:
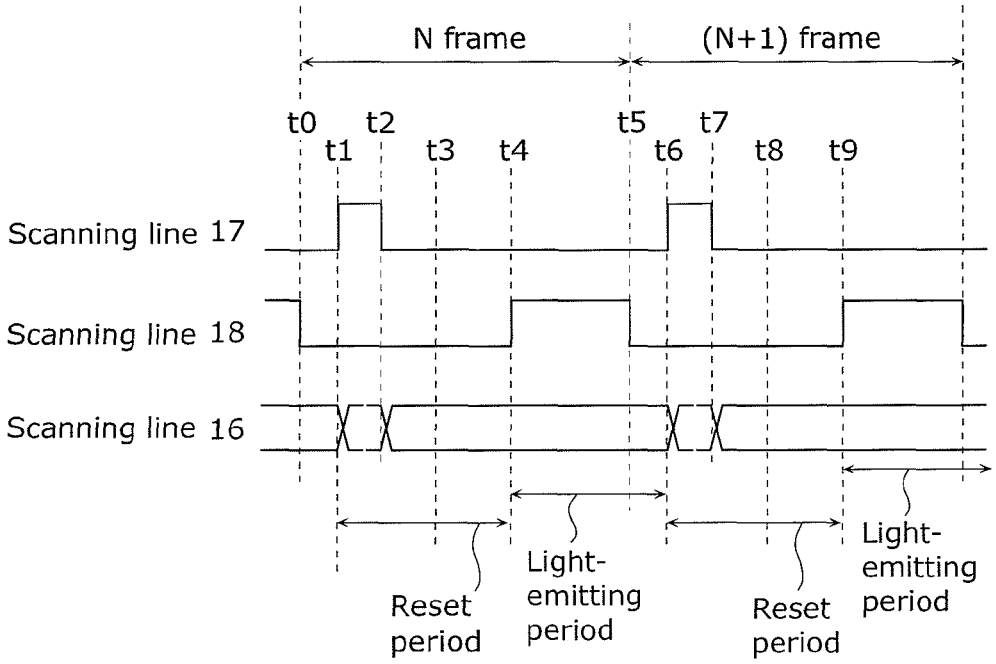
FIG. 3A is an example of a chart showing operation timings in a method of controlling the image display device according to Embodiment 1.
Figure 3B:
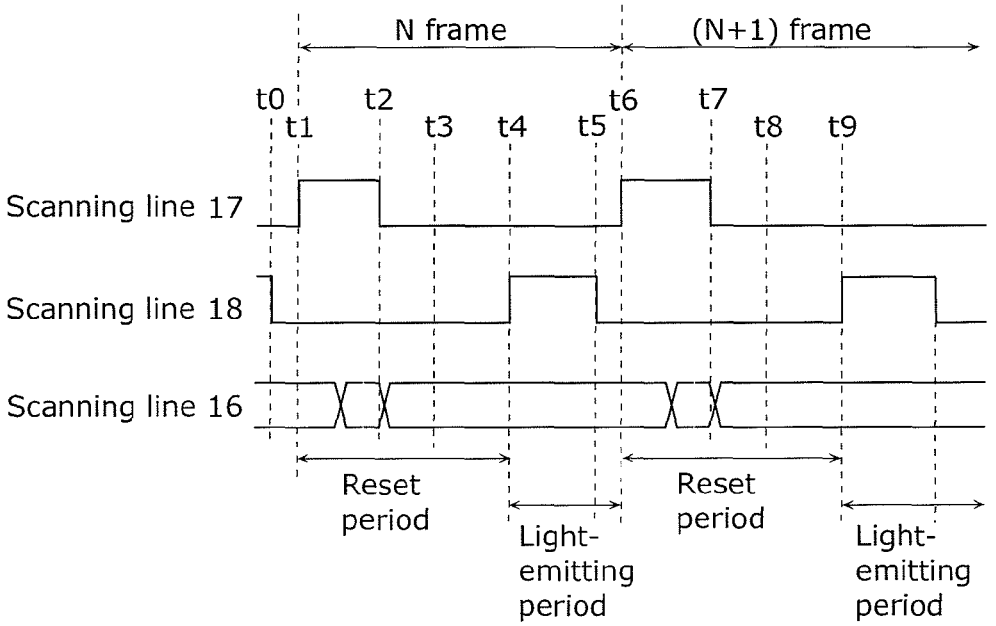
FIG. 3B is another example of a chart showing operation timings in the method of controlling the image display device according to Embodiment 1.

FIG. 3A is an example of a chart showing operation timings in the method of controlling the image display device according to Embodiment 1. FIG. 3B is another example of a chart showing operation timings in the method of controlling the image display device according to Embodiment 1. In FIG. 3A and FIG. 3B, the horizontal axis represents time. In the vertical direction, waveforms of voltages generated in the scanning line 17, the scanning line 18, and the signal line 16 are shown from top to bottom in this sequence.

In addition, FIG. 4A to FIG. 4J are diagrams for describing the charts showing operation timings in the method of controlling the image display device according to Embodiment 1, and each shows a pixel circuit in a conducting state. Descriptions are given below where, for example, the voltage levels of the scanning line 17 and the scanning line 18 are +20 V in HIGH and −10 V in LOW. However, different voltage levels (HIGH or LOW) may be given to the scanning line 17 and the scanning line 18 according to the electrical characteristics of the switching transistors 11, 12 and 19.

Figure 4A:
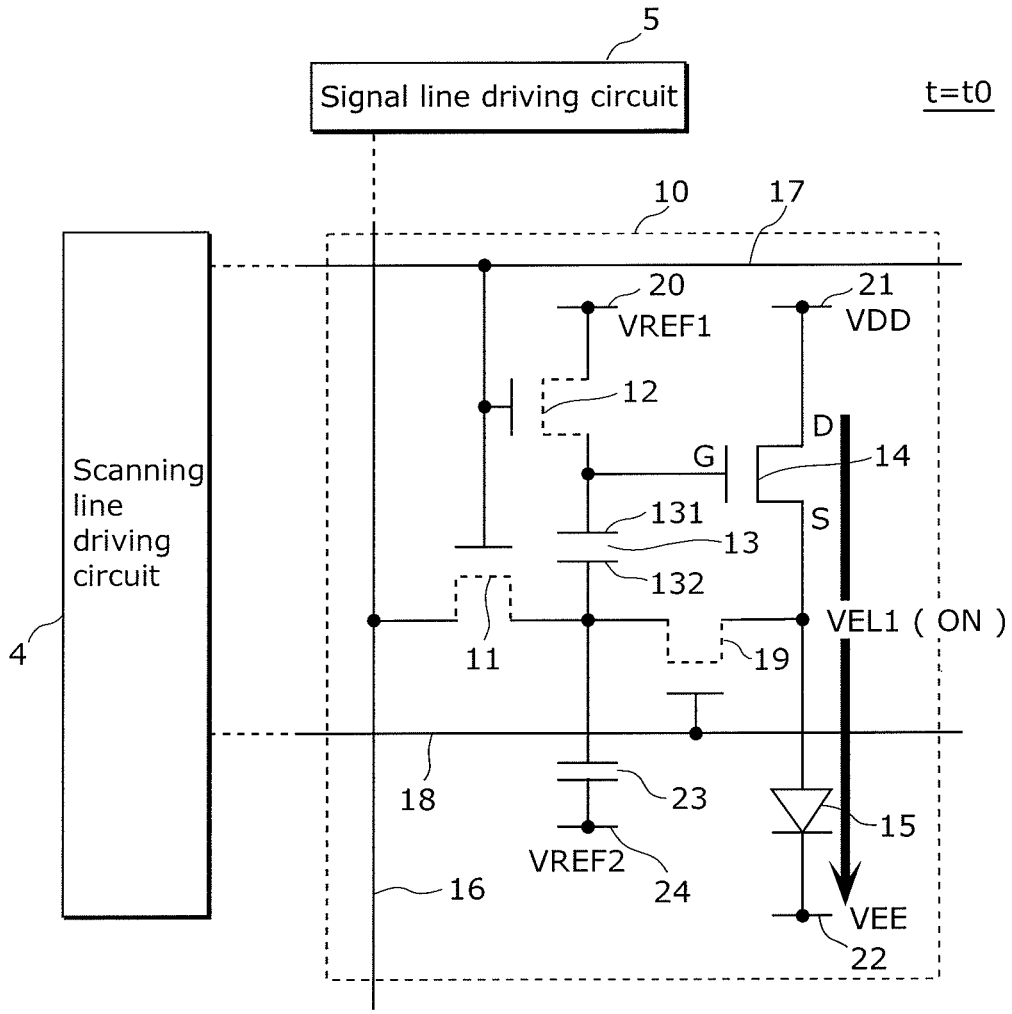
FIG. 4A is a diagram for describing a chart showing operation timings in the method of controlling the image display device according to Embodiment 1.

First, at time t0, as shown in FIG. 3A, the scanning line driving circuit 4 maintains the voltage level of the scanning line 17 low, while the switching transistors 11 and 12 are off. In addition, the scanning line driving circuit 4 changes the voltage level of the scanning line 18 from HIGH to LOW to turn off the switching transistor 19. With this, the source of the driving transistor 14 and the electrode 132 of the electrostatic capacitor 13 are turned off (made non-conducting) (FIG. 4A). Hence, time t0 is immediately after the source of the driving transistor 14 and the electrode 132 of the electrostatic capacitor 13 became off state (non-conducting state), the voltage value of the electrode 132 of the electrostatic capacitor 13 is held to the voltage (VEL1(ON)) of the anode of the organic EL element 15 by the electrostatic capacitor 23, and the gate voltage of the driving transistor 14 is also held by the electrostatic capacitor 13 to the voltage at which the switching transistor 19 is on; thereby continuing light emission of the organic EL element 15.

Next, at time t1, as shown in FIG. 3A, the data voltage to the second electrode of the electrostatic capacitor 13 starts to be set (write period starts), and reset period of the driving transistor 14 also starts.

Figure 4B:
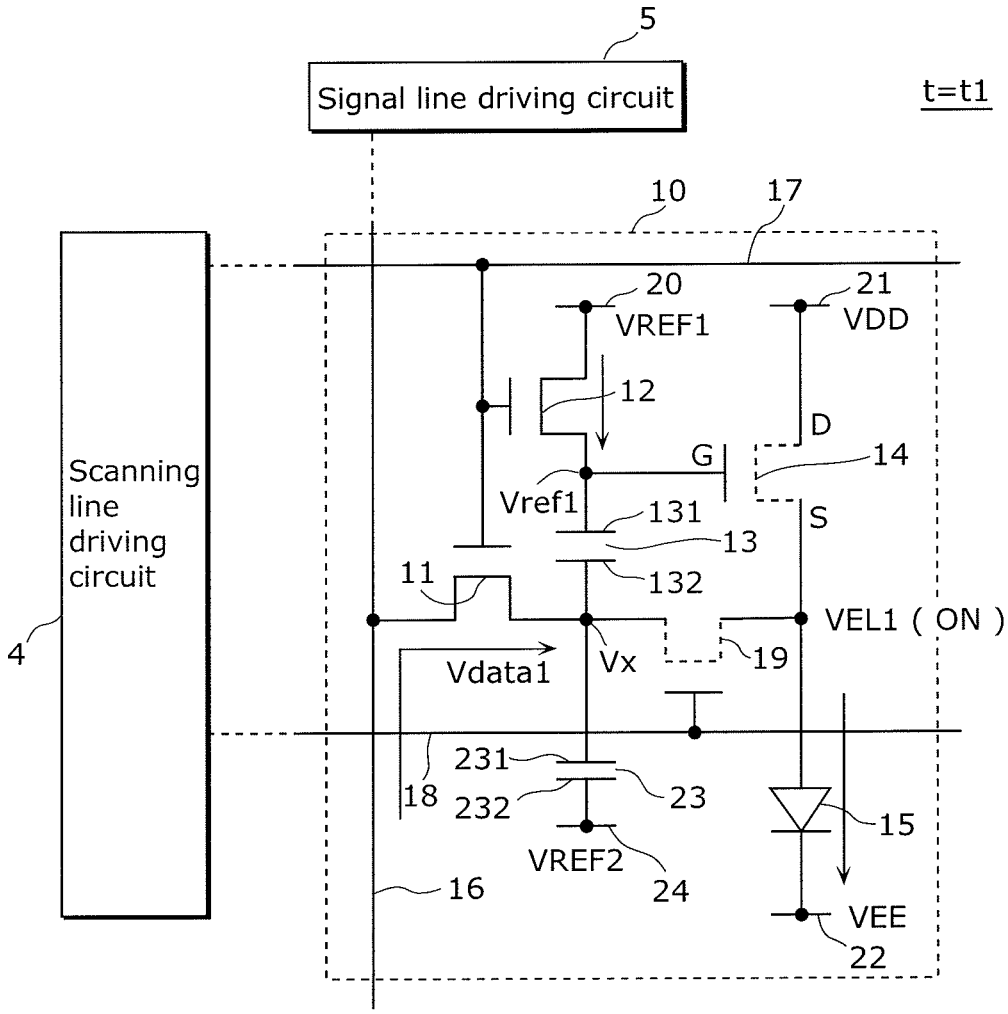
FIG. 4B is another diagram for describing the chart showing operation timings in the method of controlling the image display device according to Embodiment 1.

More specifically, as shown in FIG. 3A and FIG. 4B, the scanning line driving circuit 4 maintains the voltage level of the scanning line 18 low, and the switching transistor 19 keeps to be off (non-conducting). In addition, the scanning line driving circuit 4 changes the voltage level of the scanning line 17 from LOW to HIGH while the switching transistor 19 is off (non-conducting) to turn on the switching transistors 11 and 12 (make the switching transistors 11 and 12 conducting).

More specifically, at time t1, the reference voltage (VREF1) of the reference power source line 20 is applied to the gate of the driving transistor 14, and the voltage which corresponds to the sum of the voltage (VEE) of the negative power source line 22 and the voltage greater than or equal to the absolute value of the luminescence threshold voltage of the organic EL element 15 is applied to the source of the driving transistor 14. In addition, the reference voltage VREF1 of the reference power source line 20 is applied to the electrode 131 of the electrostatic capacitor 13, thereby keeping the reference voltage (VREF1) of the reference power source line 20. In such a manner, the driving transistor 14 is turned off.

In other words, at time t1, since the switching transistor 19 is off (non-conducting), the anode electrode of the organic EL element 15 which corresponds to the source voltage of the driving transistor 14 gradually approaches the sum of the voltage (VEE) of the negative power source line 22 and the absolute value of the luminescence threshold voltage of the organic EL element 15. With this, unnecessary charges accumulated in the driving transistor 14 in the non-light-emitting period of the previous frame ((N−1) frame) starts discharging, that is, reset of the driving transistor 14 starts.

At time t1, the signal line driving circuit 5 applies the data voltage (Vdata1) to the signal line 16. Then, the data voltage (Vdata1) of the signal line 16 is set to the electrode 132 (Voltage Vx) of the electrostatic capacitor 13. On the other hand, the reference voltage (VREF1) of the reference power source line 20 is set to the electrode 131 of the electrostatic capacitor 13. Accordingly, the voltage corresponding to the potential difference between the data voltage (Vdata) and the reference voltage (VREF1) is held by the electrostatic capacitor 13.

Furthermore, the reference voltage (VREF1) is an off-voltage which turns off the driving transistor 14 (makes the driving transistor 14 non-conducting). To turn off the driving transistor 14, the relation of VREF1≤VEE+Vth(EL)+Vth (TFT) has to be satisfied where Vth (EL) denotes the luminescence threshold voltage of the organic EL element 15 and Vth (TFT) denotes the threshold voltage of the driving transistor 14. For example, where the threshold voltage of the driving transistor 14 is 1V, and the absolute value of the luminescence threshold voltage of the organic EL element 15 is 2V, it is set such that the voltage of the positive power source line 21 is 25V, the voltage of the negative power source line 22 is 10V, and the voltage of the reference power source line 20 is 10V.

Furthermore, the fixed voltage which corresponds to the potential (VEE) of the negative power source line 22 starts to be set to the source of the driving transistor 14.

Here, the fixed voltage which corresponds to the potential (VEE) of the negative power source line 22 refers to, for example, the value of the sum of the voltage (VEE) of the negative power source line 22 and the absolute value of the threshold voltage at which the organic EL element 15 starts to emit light. Hence, a reverse bias (a constant voltage), which satisfies the relation of Vgs−Vth<0, starts to be applied to the driving transistor 14.

At this time, a current does not flow between the source and the drain of the driving transistor 14; and thus, the organic EL element 15 does not emit light. In other words, at time t1, light emission of the organic EL element 15 stops. With this, the case where the switching transistors 11 and 12 are made conducting via the scanning line 17 while the switching transistor 19 is off (non-conducting) corresponds to that a reverse bias (constant voltage) is applied between the gate and the source of the driving transistor 14. Accordingly, a decrease in the source potential of the driving transistor 14 due to self-discharge of the organic EL element 15 (reset period) steadily starts.

In the period from time t1 to time t2, as shown in FIG. 3A, the voltage level of the scanning line 17 is HIGH; and thus, the signal voltage (Vdata1) is applied from the signal line 16 to the electrode 132 of the light-emitting pixel 10 from the signal line 16, and in a similar manner, the fixed voltage which corresponds to the potential (VEE) of the negative power source line 22 is set to the source of the driving transistor 14 for each light-emitting pixel belonging to the pixel row including the light-emitting pixel 10.

In this period, only capacitive load is connected to the reference power source line 20, thereby causing no steady current while the voltage level of the scanning line 17 is HIGH. As a result, no voltage drop occurs. In addition, the potential difference between the drain and the source of the switching transistor 12 is 0V when charging of the electrostatic capacitor 13 completes. The same applies to the signal line 16 and the switching transistor 11. Accordingly, the accurate reference potential (VREF1) which corresponds to the signal voltage and the signal voltage (Vdata) are respectively applied to the electrodes 131 and 132 of the electrostatic capacitor 13.

Figure 4C:
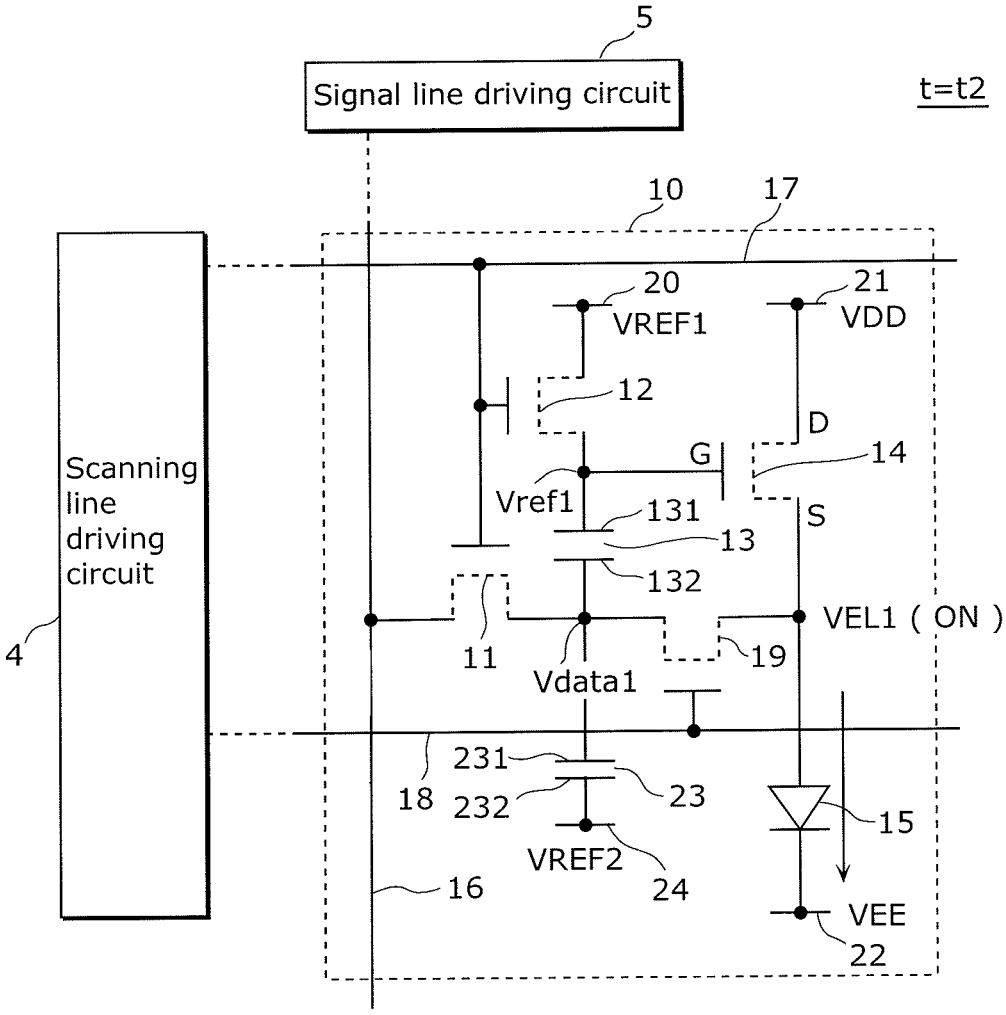
FIG. 4C is another diagram for describing the chart showing operation timings in the method of controlling the image display device according to Embodiment 1.
Figure 4D:
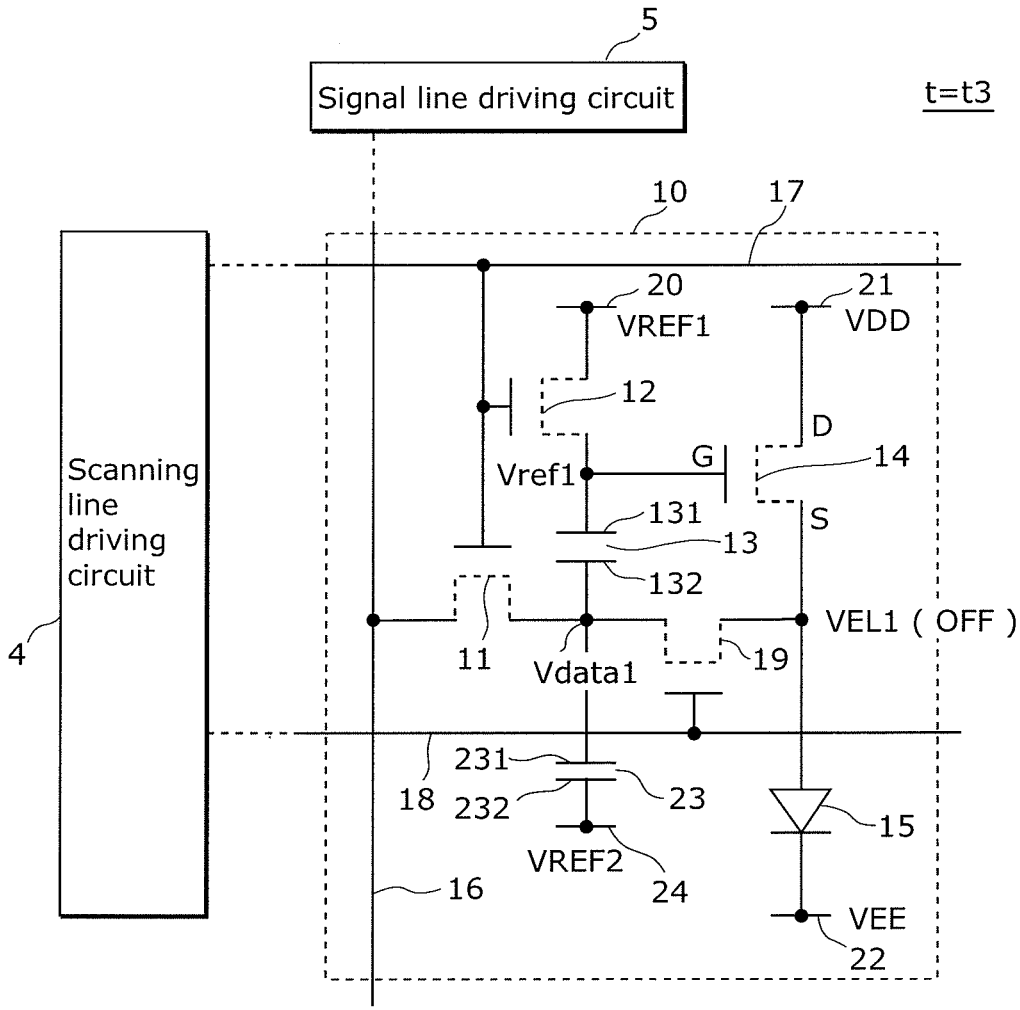
FIG. 4D is another diagram for describing the chart showing operation timings in the method of controlling the image display device according to Embodiment 1.

Next, at time t2, as shown in FIG. 3A, the scanning line driving circuit 4 changes the voltage level of the scanning line 17 from HIGH to LOW to turn off the switching transistors 11 and 12 (make the switching transistors 11 and 12 non-conducting). With this, as shown in FIG. 4C, the electrode 131 of the electrostatic capacitor 13 and the reference power source line 20 become an off-state (non-conducting state), and the electrode 132 of the electrostatic capacitor 13 and the signal line 16 also become an off-state (non-conducting state).

More specifically, at time t2, as shown in FIG. 3A, the scanning line driving circuit 4 maintains the voltage level of the scanning line 18 LOW, and the switching transistor 19 keeps to be off (non-conducting). While the switching transistor 19 is off (non-conducting), the scanning line driving circuit 4 changes the voltage level of the scanning line 17 from HIGH to LOW to turn off the switching transistors 11 and 12 (make the switching transistors 11 and 12 non-conducting). The reset of the driving transistor continues. This is because even after the switching transistors 11 and 12 are changed from on (conducting state) into off (non-conducting state), the electrostatic capacitor 23 reduces variation in potential of the first electrode 231 of the electrostatic capacitor 23, that is, the second electrode 132 of the electrostatic capacitor 13, and the electrostatic capacitor 13 reduces variation in potential of the first electrode 131 of the electrostatic capacitor 13. More specifically, even after the time t2 at which the switching transistors 11 and 12 are turned off (made non-conducting), the electrostatic capacitors 13 and 23 stably maintains the gate potential of the driving transistor 14 VREF1, and are continuously applying a reverse bias (a constant voltage) between the gate and the source of the driving transistor 14. Hence, the longer the reset period of the driving transistor 14 is, the closer the potential of the source of the driving transistor 14 approaches the fixed voltage (VEE+Vth(EL)) which corresponds to the reference voltage (VREF1), and this is preferable. In Embodiment 1, the reset period continues till time t4. Embodiment 1 shows a case where the potential of the source of the driving transistor 14 approaches the fixed voltage (VEL(off)=VEE+Vth(EL)) which corresponds to the reference voltage (VREF1) at time t3 (For example, FIG. 4D). Here, the fixed voltage which corresponds to the reference voltage (VREF1) is the potential determined based on the electrical characteristics of the driving transistor 14, the electrical characteristics of the organic EL element 15, and the reference voltage (VREF1).

Next, at time t4, as shown in FIG. 3A, the reset period of the driving transistor 14 ends, and the light-emitting period starts. More specifically, as shown in FIG. 3A and FIG. 4E, while the scanning line driving circuit 4 maintains the voltage level of the scanning line 17 LOW and maintains the switching transistors 11 and 12 off (non-conducting), the scanning line driving circuit 4 changes the voltage level of the scanning line 18 from LOW into HIGH to turn on the switching transistor 19 (make the switching transistor 19 conducting).

Figure 4E:
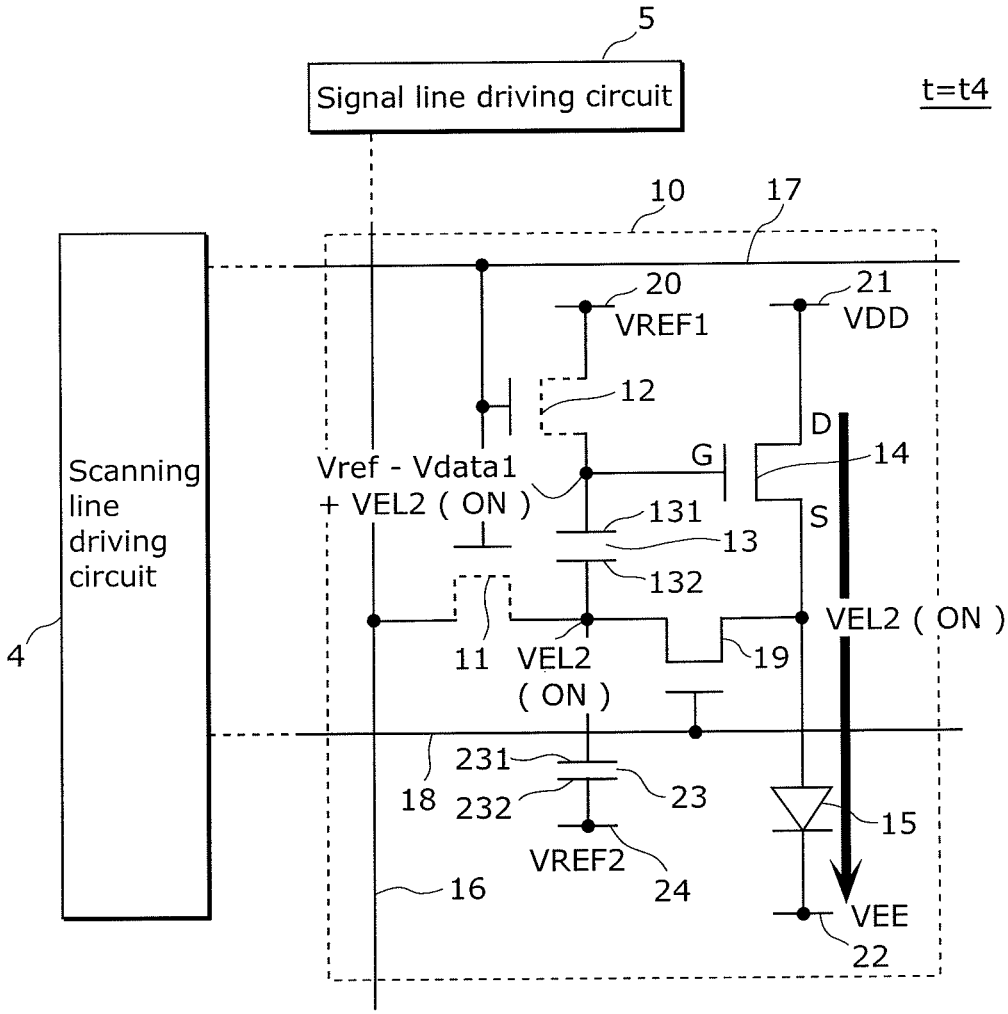
FIG. 4E is another diagram for describing the chart showing operation timings in the method of controlling the image display device according to Embodiment 1.
Figure 4F:
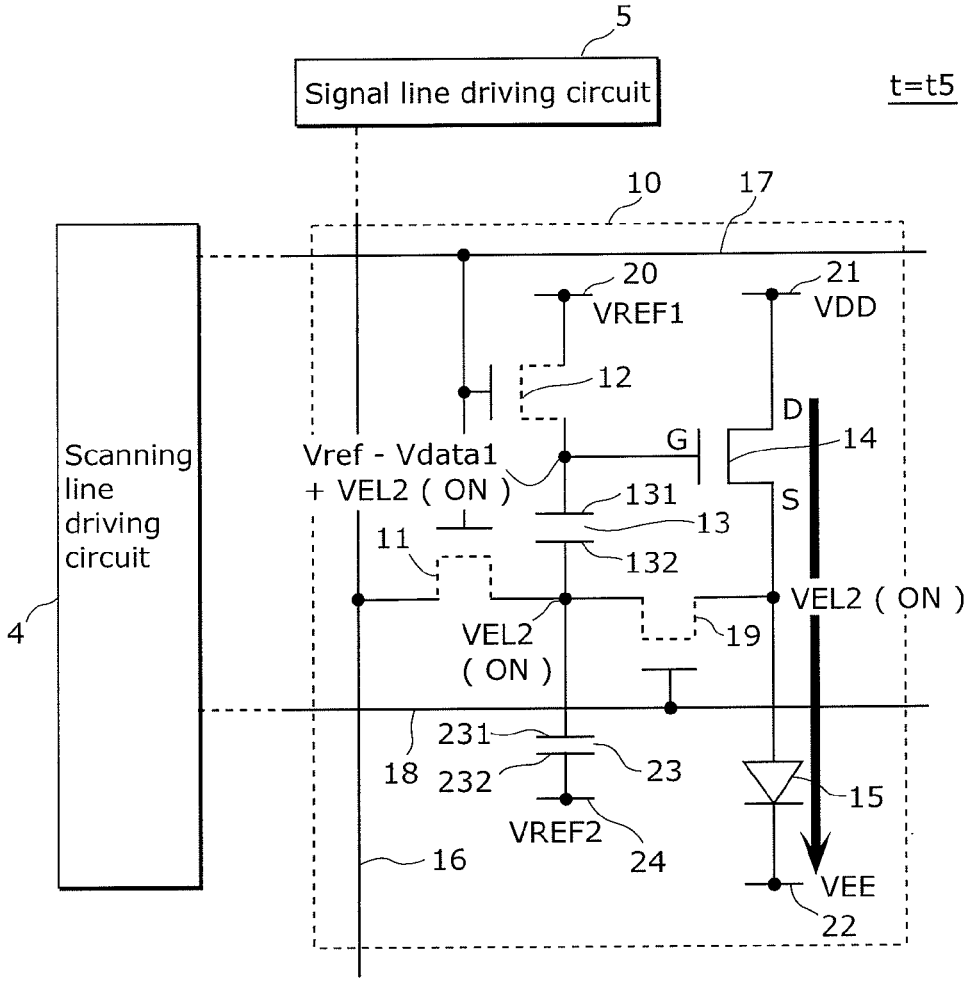
FIG. 4F is another diagram for describing the chart showing operation timings in the method of controlling the image display device according to Embodiment 1.
Figure 4G:
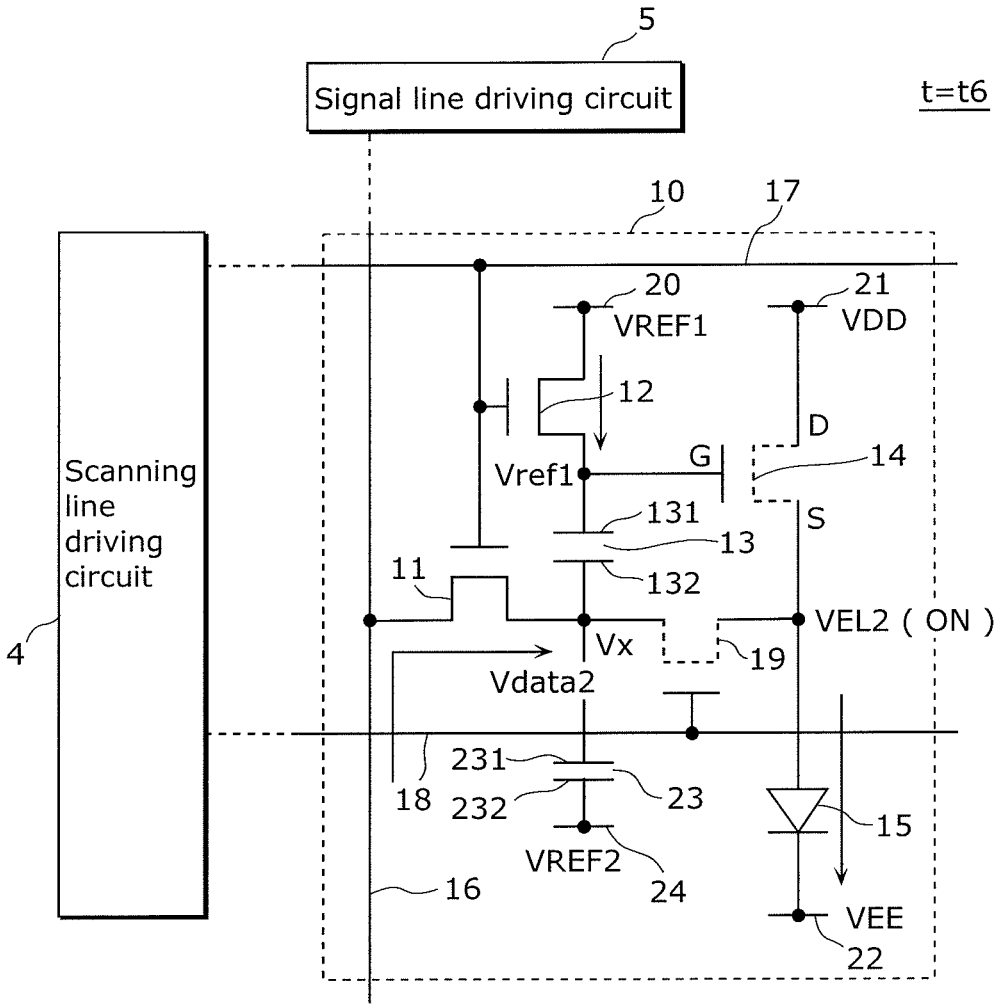
FIG. 4G is another diagram for describing the chart showing operation timings in the method of controlling the image display device according to Embodiment 1.
Figure 4H:
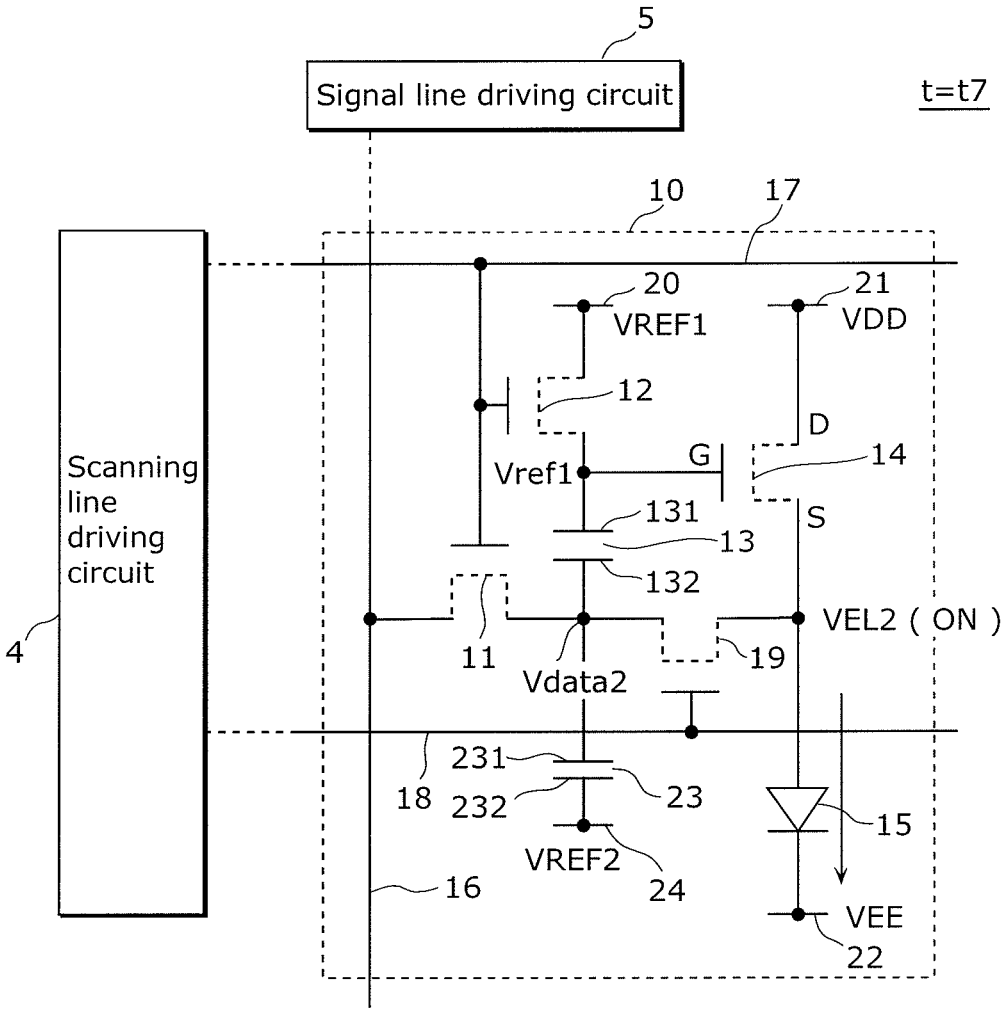
FIG. 4H is another diagram for describing the chart showing operation timings in the method of controlling the image display device according to Embodiment 1.
Figure 4I:
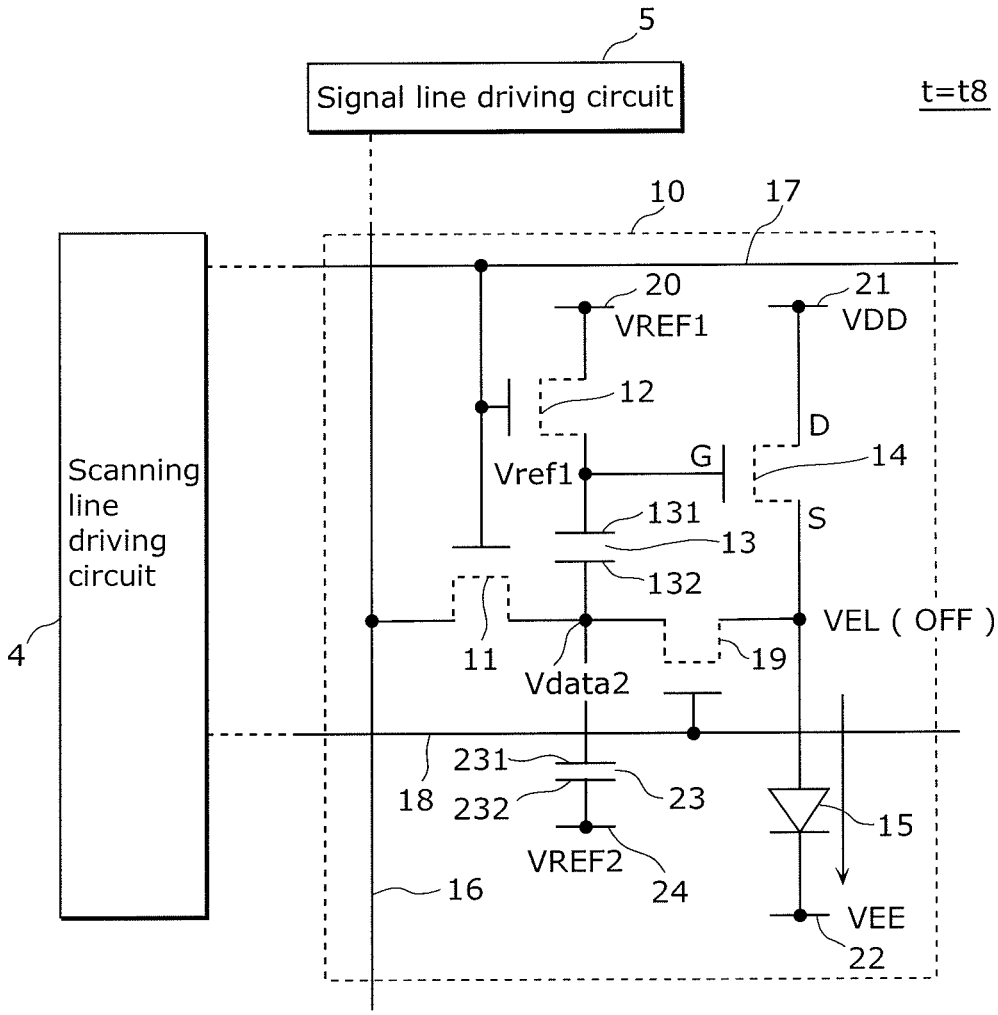
FIG. 4I is another diagram for describing the chart showing operation timings in the method of controlling the image display device according to Embodiment 1.
Figure 4J:
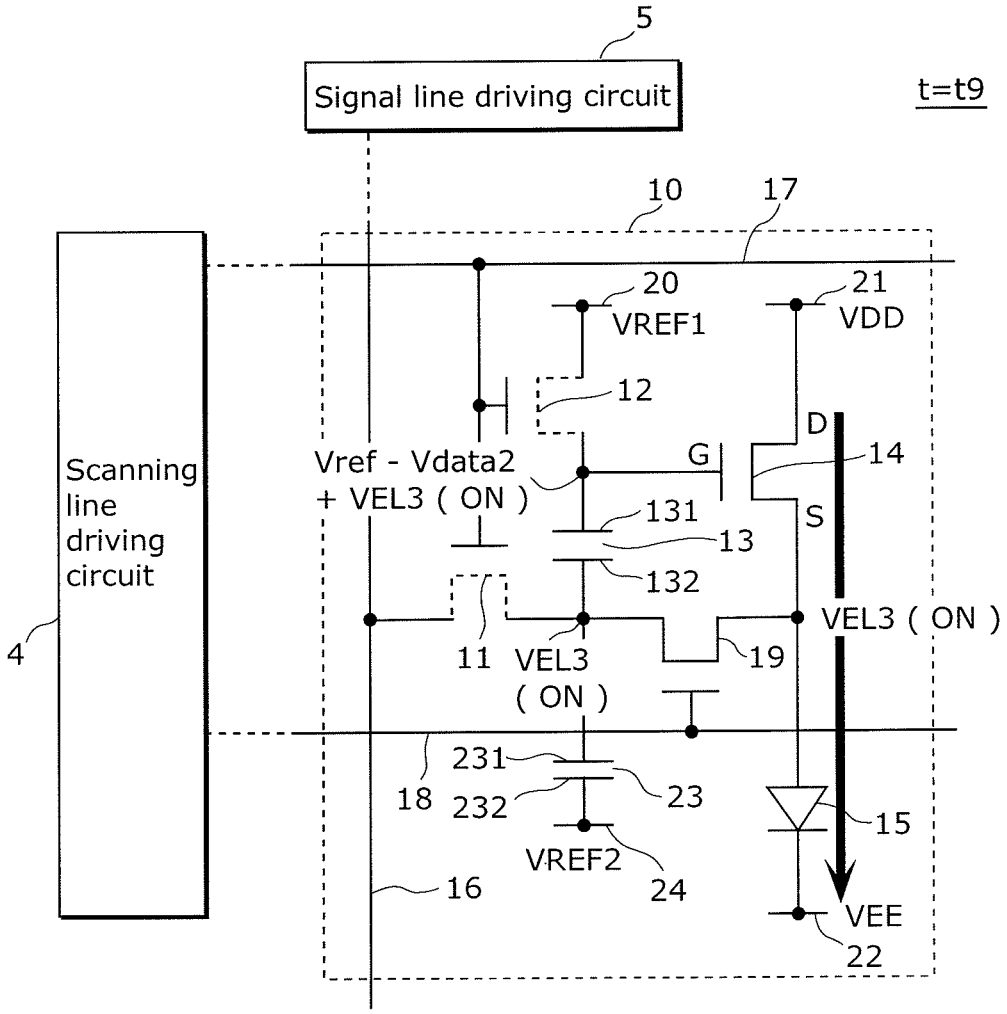
FIG. 4J is another diagram for describing the chart showing operation timings in the method of controlling the image display device according to Embodiment 1.

Then, as shown in FIG. 4E, the source of the driving transistor 14 and the electrode 132 of the electrostatic capacitor 13 are made conducting. Furthermore, the electrode 131 of the electrostatic capacitor 13 is disconnected from the reference power source line 20, and the electrode 132 of the electrostatic capacitor 13 is disconnected from the signal line 16.

With this, the gate and the source of the driving transistor 14 is connected, the potential (VREF1−Vdata+VEL(off)) of the electrode 131 of the electrostatic capacitor 13 is set to the gate of the driving transistor 14, and the potential (VEL(off)) of the electrode 132 of the electrostatic capacitor 13 is set to the source of the driving transistor 14. In other words, the potential difference (VREF1−Vdata) between the electrode 131 and the electrode 132 of the electrostatic capacitor 13 is applied between the gate and the source electrodes of the driving transistor 14. Accordingly, a current flows between the drain and the source of the driving transistor 14 according to the potential difference between the gate and the source electrodes of the driving transistor 14, thereby causing the organic EL element 15 to emit light. When the organic EL element 15 starts light emission, the potential of the source of the driving transistor 14 changes to VEL(ON). At this time, the potential (VREF1−Vdata+VEL(on)) of the electrode 131 of the electrostatic capacitor 13 is set to the gate of the driving transistor 14, and the potential difference (VREF1−Vdata) between the electrode 131 and the electrode 132 of the electrostatic capacitor 13 is continuously applied between the gate and the source electrodes of the driving transistor 14. More specifically, the gate potential of the driving transistor 14 changes according to the variation of the source potential, and the voltage between both terminals of the electrostatic capacitor 13 (VREF1−Vdata) is applied between the gate and the source of the driving transistor 14. As a result, a signal current corresponding to (VREF1−Vdata) flows into the organic EL element 15, thereby causing light emission of the organic EL element 15. In Embodiment 1, for example, the source potential of the driving transistor 14 changes from 12V into 15V due to conduction of the switching transistor 19.

In the period from time t4 to time t5 (that is, light-emitting period), (VREF1−Vdata) that is the voltage between both terminals of the electrostatic capacitor 13 is continuously applied between the gate and the source of the driving transistor 14, causing a flow of the signal current which keeps light emission of the organic EL element 15.

The period from time t0 to time t5 corresponds to a frame period in which the light emission intensity of all the light-emitting pixels included in the image display device 1 is updated, and operations as in the period from t1 to t5 are repeated at and after t5. For example, time t5 to time t9 in an N+1 frame respectively correspond to time t0 to time t4 described above. Furthermore, since the operations in the method of controlling the image display device at time t5 to time t9 shown in FIG. 3A, and FIG. 4F to FIG. 4J are the same as those performed at time t0 to time t4; and thus, their detailed descriptions are not given.

The image display device is controlled as described above, and the threshold voltage of the driving transistor 14 does not vary due to the charges accumulated in the driving transistor 14 in the light-emitting period of the previous frame. More specifically, by providing sufficient reset period as described above stabilizes the threshold voltage of the driving transistor 14. In other words, when the reset period ends, the electrical characteristics of the driving transistor 14 at the start of light emission are not influenced by the previous frame; and thus, it is possible to supply a current having a desired value to the light-emitting element 15.

Furthermore, the voltage which corresponds to the potential difference between the signal voltage (Vdata1 or the like) and the reference voltage (VREF1) is held by the electrostatic capacitor 13. At the same time, combined capacitance of the electrostatic capacitor 13 and the electrostatic capacitor 23 allows stable supply of the reference voltage (VREF1) to the gate of the driving transistor 14, thereby starting reset. As a result, for one light emission of one pixel, the signal line 16 is not occupied for the length of time corresponding to two data writes. As a result, only one write is necessary for each pixel in a row. This means that double write speed is not necessary for completing write operations on all of the rows in one frame period. In other words, it is not necessary to reduce the wiring time constant of the signal line 16 and the scanning lines 17 and 18, and to increase the thickness of the wiring film or insulating film for wiring. As a result, it is possible to reduce process time, increase throughput, and reduce cost.

Next, as described above, a description is given of the mechanism in which sufficient reset periods stabilizes the threshold voltage of the driving transistor 14 without being influenced by the previous frame.

First, a description is given to the threshold voltage of the driving transistor 14 which varies due to the charges accumulated in the driving transistor 14 in the light-emitting period of the previous frame. After that, a description is given of the reset effects obtained by the image display device and the method of controlling the image display device according to Embodiment 1.

Figure 5:
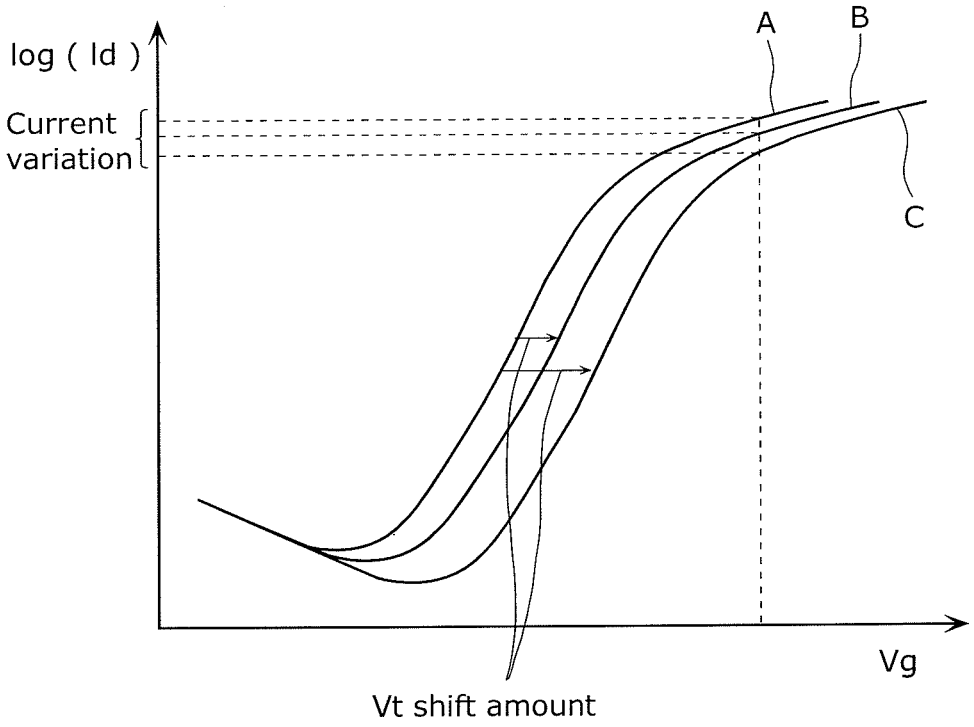
FIG. 5 is a characteristic diagram showing that a threshold voltage varies due to the charges accumulated in a driving transistor.
Figure 6:
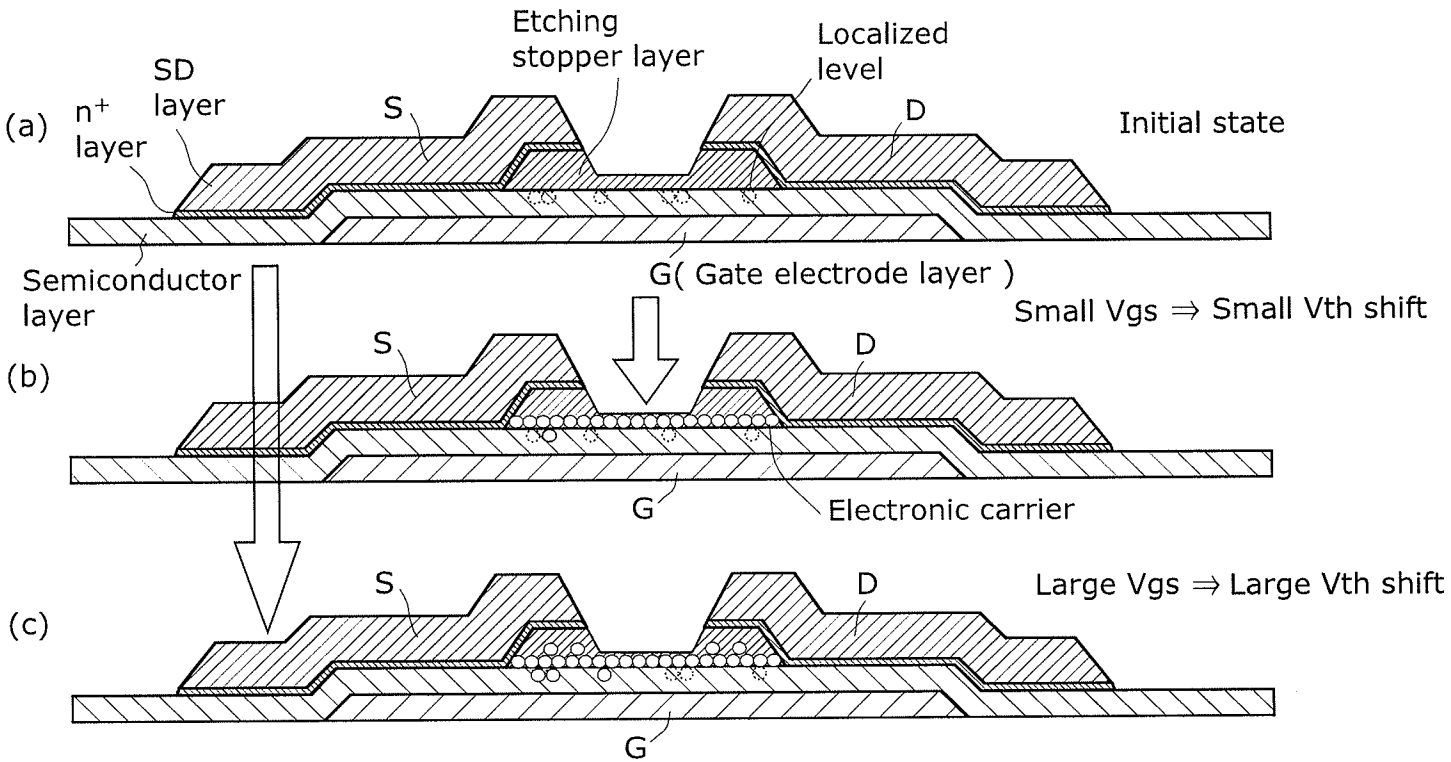
FIG. 6 schematically shows the charges accumulated in a driving transistor.
Figure 7:
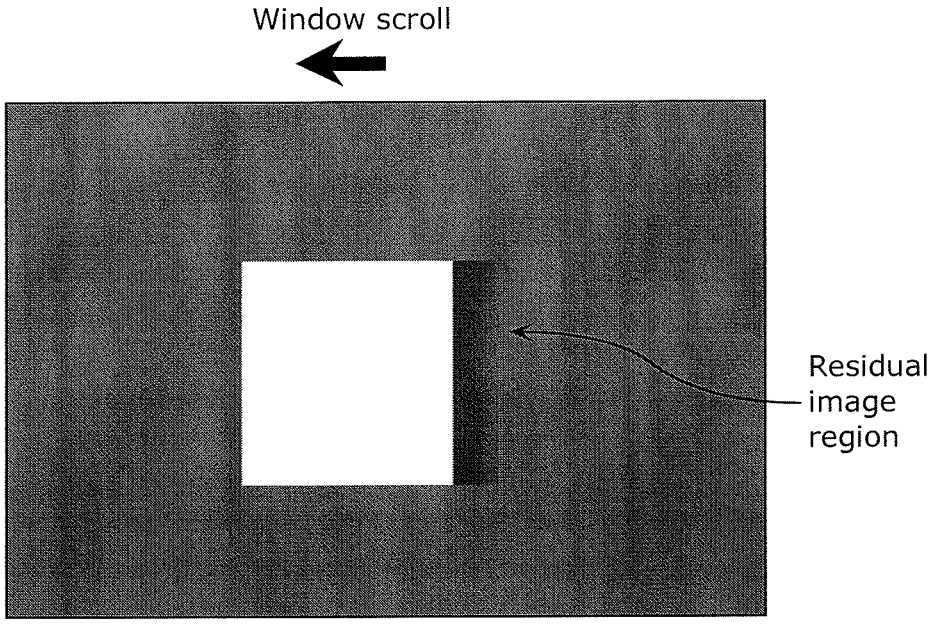
FIG. 7 is a diagram of an example where a residual image occurs due to hysteresis characteristics of driving transistors.

FIG. 5 is a characteristic diagram showing that a threshold voltage varies due to the charges accumulated in a driving transistor. FIG. 6 schematically shows the charges accumulated in a driving transistor. FIG. 7 is a diagram showing an example where a residual image occurs due to hysteresis characteristics of the driving transistors.

In FIG. 5, the vertical axis indicates the log value (Id) of the current values and the horizontal axis indicates the gate voltage values applied to the gate.

Here, a line A shown in FIG. 5 indicates initial characteristics of a driving transistor. FIG. 6(*b*) schematically shows the charges accumulated in the driving transistor having the initial characteristics (line A). In the similar manner, a line B indicates the characteristics of the driving transistor 14 in a case where the voltage stress (also referred to as Vgs stress) applied between the gate and the source of the driving transistor 14 is small. FIG. 6(*b*) schematically shows the charges accumulated in the driving transistor 14 having the characteristics indicated by the line B. Furthermore, a line C indicates the characteristics of the driving transistor 14 in a case where Vgs stress is large. FIG. 6(*c*) schematically shows the charges accumulated in the driving transistor 14 having the characteristics indicated by the line C.

As understood from FIG. 5 and FIG. 6, the larger the Vgs stress applied to the driving transistor 14 is, the greater the amount of the charges accumulated is. It is also understood that the greater the amount of the charges accumulated is (the larger the Vgs stress applied is), the greater the variation in the threshold of the driving transistor (Vth shift) is. More specifically, this accumulation of charges causes hysteresis in the voltage-current characteristics of the driving transistor.

Furthermore, it is known that it takes relatively long to accumulate charges under the Vgs stress, and it also takes relatively long to eliminate the accumulated charges. Thus, insufficient reset periods in a panel results in a residual image, as shown in FIG. 7, generated due to hysteresis characteristics of the driving transistors. Furthermore, in a case where writing a luminance signal voltage and writing a signal voltage for stopping light emission of a pixel are performed separately for setting a reset period, it is necessary to reduce the wiring time constant of the signal line 16 and the scanning lines 17 and 18.

Figure 8:
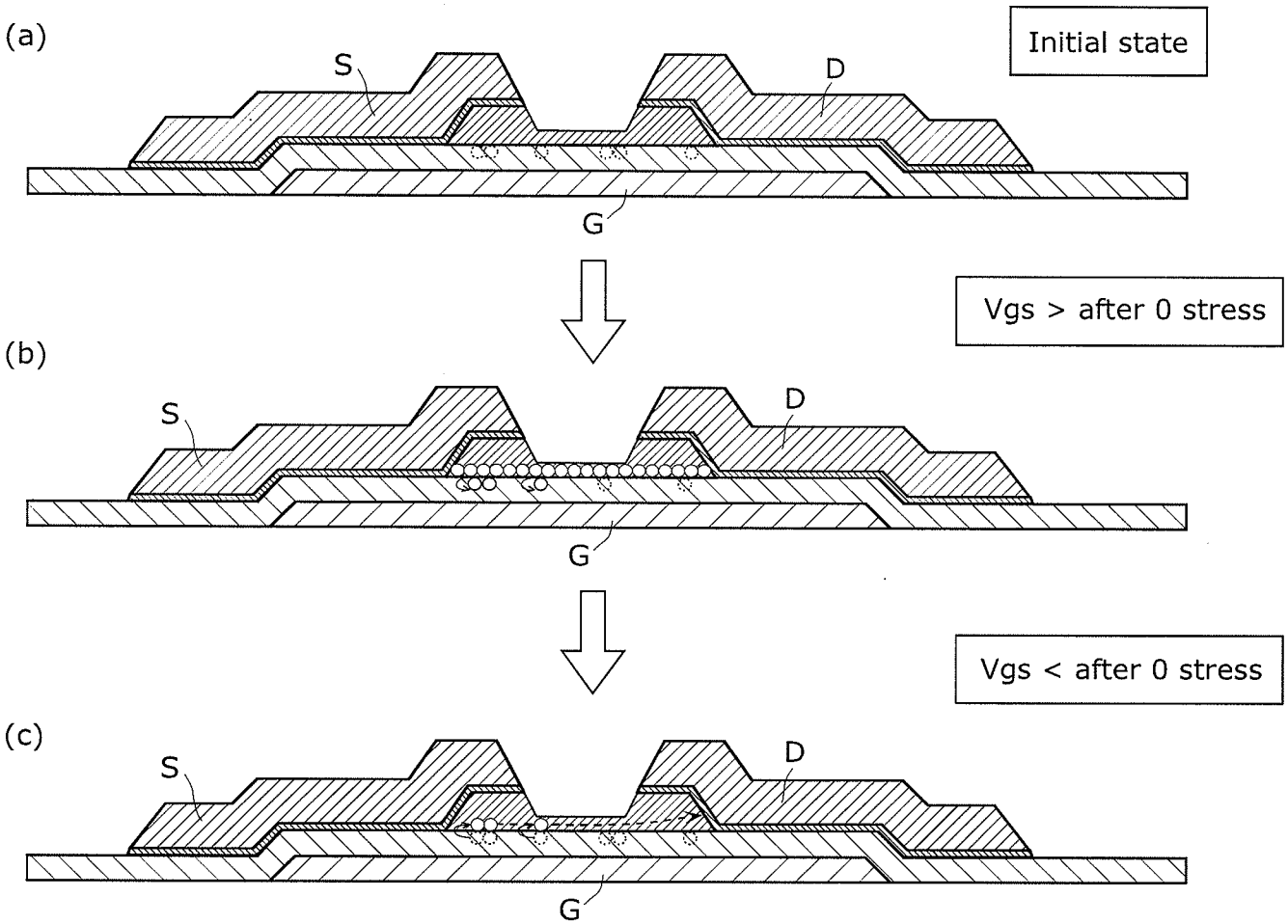
FIG. 8 schematically shows the reset effects which eliminate the charges accumulated in a driving transistor.

On the other hand, according to the image display device and the method of controlling the image display device according to Embodiment 1, writing once allows writing both of a signal voltage (VREF1) for stopping light emission of a pixel and a luminance signal voltage (Vdata), eliminating the need for significantly reducing the wiring time constant of the signal line 16 and the scanning lines 17 and 18. Furthermore, reset periods during which a reverse bias is applied can be sufficiently provided; and thus, it is possible to eliminate accumulation of charges and change the characteristics of the driving transistor back to the initial characteristics. This is schematically shown in FIG. 8. FIG. 8 schematically shows the reset effects which eliminates the charges accumulated in a driving transistor. FIG. 8 schematically shows the reset effects, using the structure shown in FIG. 6.

As shown in (a) in FIG. 8, Vgs stress having the relation of Vgs>0 is applied to a driving transistor in an initial state. Then, as shown in (b) in FIG. 8, charges are trapped at a localized level of the gate insulating film of the driving transistor, thereby accumulating charges. Here, the Vgs stress having the relation of Vgs>0 refers to, for example, a state where 0V is applied to the source, 5V is applied to the drain, and 5V is applied to the gate.

Then, after the sufficient reset period according to the control method, as shown in (c) in FIG. 8, the charges trapped at the localized level of the gate insulating film of the driving transistor are discharged, resulting in the state same as the initial state. Here, in the reset period, with respect to the driving transistor, for example, 12V is applied to the source, 25V is applied to the drain, and 10V is applied to the gate, meaning that Vgs stress having the relation of Vgs<0 is applied. Accordingly, the charges trapped at the localized level of the gate insulating film of the driving transistor are discharged.

Figure 9:
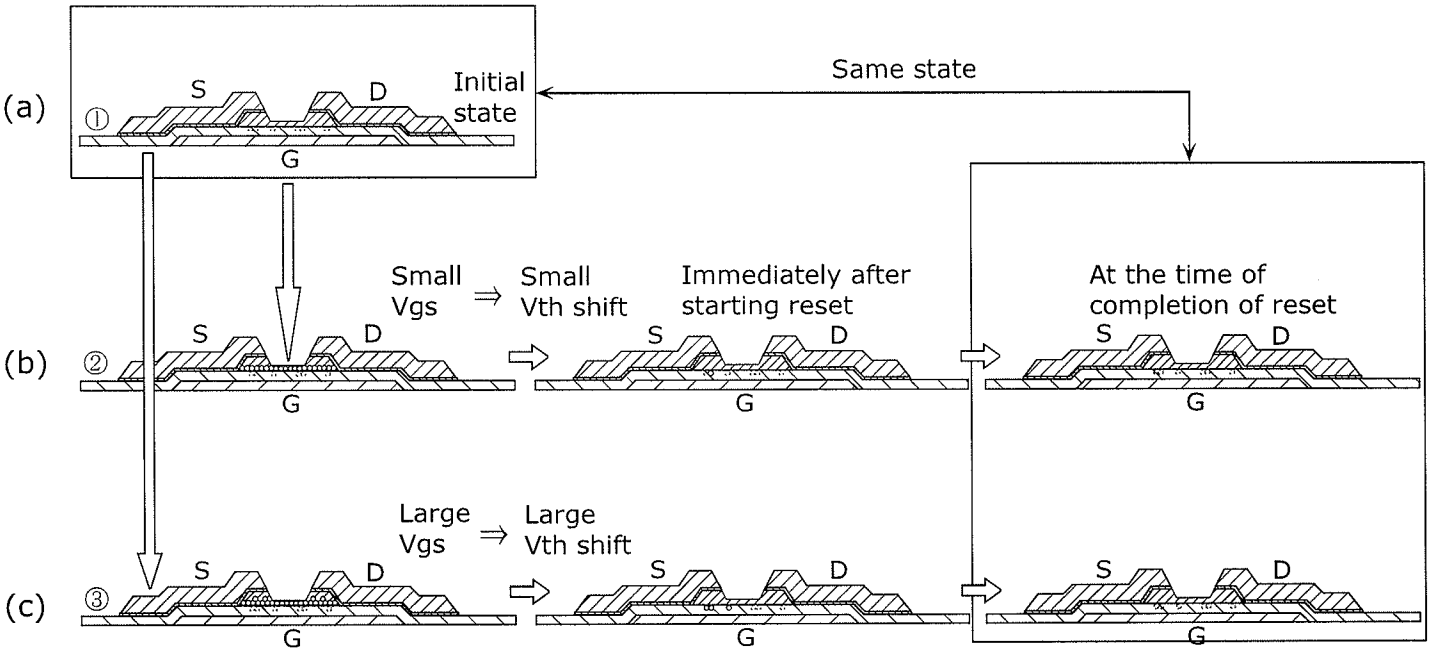
FIG. 9 is a diagram showing the reset effects on the charges accumulated in the driving transistor shown in FIG. 6.

FIG. 9 is a diagram showing the reset effects on the charges accumulated in the driving transistor shown in FIG. 6. As shown in FIG. 9, with respect to the charges accumulated in the driving transistor shown in FIG. 6, providing a sufficient reset period allows the charges accumulated in the driving transistor to be eliminated. Accordingly, it is possible to change the characteristics of the driving transistor back to the initial state.

Figure 10:
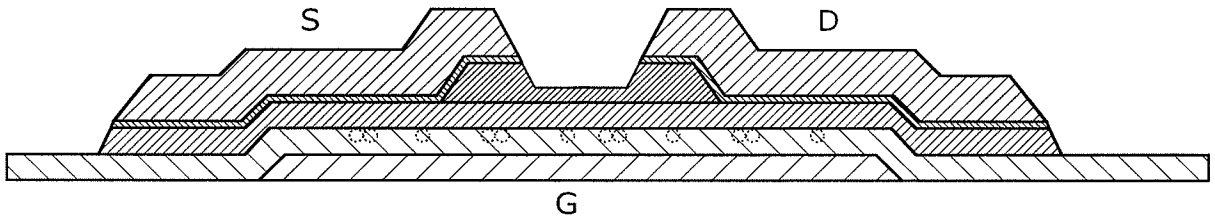
FIG. 10 schematically shows a configuration of a driving transistor including an etching stopper.

Furthermore, in the above description, the driving transistor has a channel-etch as an example; however, the configuration of the driving transistor is not limited to the example. As shown in FIG. 10, the driving transistor may have an etching-stopper. FIG. 10 schematically shows a configuration of a driving transistor having an etching stopper.

As described, according to the image display device and the method of controlling the image display device according to Embodiment 1, it is possible to reduce occurrence of a residual image due to hysteresis characteristics of the driving transistors, with simple pixel circuits.

More specifically, control by the scanning line 17 sets a signal voltage to the electrode 132 of the electrostatic capacitor 13 and also starts resetting of the driving transistor 14. As a result, it is possible to provide sufficient reset periods without significantly reducing the wiring time constant of the signal line 16 and the scanning lines 17 and 18. Furthermore, delaying the start of light emission of the organic EL element 15 by controlling the scanning line 18 allows longer reset period of the driving transistor 14.

As a result, in such a simple configuration where the switching transistors 11 and 12 are controlled by the common scanning line 17, a simple control allows setting the data voltage to the electrode 132 of the electrostatic capacitor 13 and starting reset of the driving transistor 14, and another simple control allows starting light emission of the organic EL element 15 and ending reset of the driving transistor 14. This reduces the influences (residual images) by the hysteresis characteristics.

It is preferable that the reset period described above is 20 percent or more of one frame period. The reset period is the same period as the non-light-emitting period according to the above control method. Here, the non-light-emitting period is, for example, a period from time t1 to time t4, and corresponds to a period from when the switching transistors 11 and 12 are made conducting while the switching transistor 19 is non-conducting to when the switching transistor 19 is made conducting while the switching transistors 11 and 12 are non-conducting. Furthermore, one frame period is, for example, a period from time t1 to time t6, and corresponds to a period from when the switching transistors 11 and 12 are made conducting while the switching transistor 19 is non-conducting (time t1) to when the switching transistors 11 and 12 are made conducting while the switching transistor 19 is non-conducting (time t6).

Embodiment 2

In Embodiment 1, a description has been given of an example of the control method without consideration of signal transmission delay which occurs when the scanning line driving circuit 4 applies an on-voltage to the scanning line 17. In Embodiment 2, a description is given of an example of the control method with consideration of signal transmission delay of the scanning line 17.

First, a description is given of the signal transmission delay of the scanning line 17, referring to FIG. 1 and FIG. 2.

The signal transmission delay of the scanning line 17 is defined by the wiring resistance of the scanning line 17, and capacitance generated between the scanning line 17 and one of the other control lines or power source lines, such as the signal line 16, the scanning line 18, the reference power source line 20, the positive power source line 21 and the negative power source line 22. More specifically, when the output of the scanning line driving circuit 4 applied to the scanning line 17 is changed from an on-voltage into an off-voltage, the potential of the scanning line 17 at a point, which is farthest from the output terminal of the scanning line driving circuit 4 and is mostly influenced by wiring delay, asymptotically approaches an off-voltage with a given time constant.

Here, it is assumed that Vgth denotes the threshold voltage at which the switching transistors 11 and 12 are switched between ON (conducting) and OFF (non-conducting). It is defined that T21 denotes the time required for the voltage, applied from the scanning line 17 to the switching transistors 11 and 12 for changing the voltage level of the scanning line 17 from LOW into HIGH at time t1 or time t6 shown in FIG. 3A, to become Vgth.

Furthermore, assume that T22 denotes the time required for the voltage applied to the signal line 16 at time t1 or time t6 shown in FIG. 3A to become Vdata. It is also assumed that T23 denotes the time required for the potential of the signal line 16 and the potential of the light-emitting pixel 10 (the potential of the electrode 132 of the electrostatic capacitor 13) become equal, and T1H denotes one horizontal period.

Here, at time t2 or time t7 shown in FIG. 3A, the potential of the signal line 16 cannot be changed till the potential of the scanning line 17 at a point farthest from the output terminal of the scanning line driving circuit 4 becomes lower than Vgth. Thus, an approximative relation of expression 1 below exists.

$$T1H \geq T21+T22+T23 \quad \text{(Expression 1)}$$

In Embodiment 2, in consideration with signal transmission delay of the scanning line 17, at time t2 or time t7 shown in FIG. 3A, an image display device is controlled using an overdrive method. Its description is given below.

Figure 11:
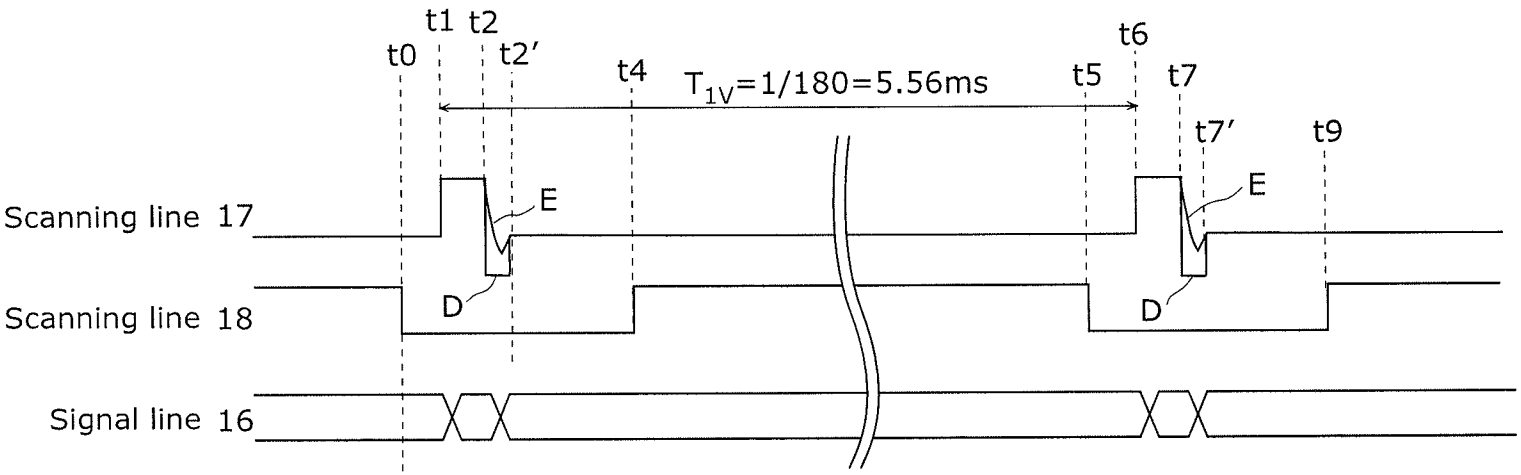
FIG. 11 is an example of a chart showing operation timings in a method of controlling an image display device according to Embodiment 2.

FIG. 11 is an example of a chart showing operation timings in a method of controlling an image display device according to Embodiment 2. The elements similar to those in FIG. 3A are assigned with the same referential numerals, and their detailed descriptions are not given. Hereinafter, a High-level voltage at a steady state of the scanning line 17 is referred to as an on-voltage, and a Low-level voltage at a steady state of the scanning line 17 is referred to as an off-voltage.

As shown in FIG. 11, in Embodiment 2, when the voltage level of the scanning line 17 is changed from HIGH (on-voltage) into LOW (off-voltage, for example, voltage of the scanning line 17 at time t4), overdrive is performed at time t2 or time t7 for changing the on-voltage into an overdrive voltage that is lower than the off-voltage, and then changed into the off-voltage.

In other words, when the switching transistors 11 and 12 are switched from ON (conducting) to OFF (non-conducting) via the scanning line 17, the scanning line driving circuit 4 performs overdrive in which an overdrive voltage that is lower than the off-voltage is applied to the scanning line 17 and then an off-voltage is applied to the scanning line 17.

By performing overdrive in such a manner, the voltage of the scanning line 17 is changed from the on-voltage into the overdrive voltage, and then is changed into an off-voltage. Thus, the length of T21 in this case can be reduced compared to the case where the voltage of the scanning line 17 is changed from the on-voltage directly into the off-voltage. As a result, the minimum value of the T1H can be smaller, allowing reducing the length of one frame period as one frame period corresponds to T1H×(vertical synchronous frequency). More specifically, it is possible to increase frame frequency of display, increase vertical synchronous frequency, and increase the number of display pixels.

By performing overdrive in the manner described above, it is possible to increase the operation speed of the scanning line 17. However, if the length of an OD period during which an overdrive voltage is applied (a period from t2 to t2', or a period from t7 to t7' in FIG. 11) increases, the gate electrode of the switching transistor 11 becomes the overdrive voltage in the OD period. This reduces the off-characteristics of the switching transistor 11, causing leak current. In other words, the switching transistor 11 is not turned off (not made non-conducting) completely. Hence, the data voltage (Vdata) from the signal line 16 is not accurately written into the electrode 132 of the electrostatic capacitor 13. This results in, for example, reduced display quality, such as crosstalk.

In Embodiment 2, as shown in FIG. 11, the length of the OD period is less than or equal to the wiring time constant of the scanning line 17. In other words, the OD period during which the overdrive voltage is applied to the gate electrodes of the switching transistors 11 and 12 is shorter than the period during which the on-voltage is applied to the gates of the switching transistors 11 and 12.

Accordingly, the waveform of the scanning line 17 (D in FIG. 11) does not reach the OD voltage. As a result, it is possible to reduce the length of time during which the on-voltage of the scanning line 17 is lower than Vgth, and also to turn off the switching transistor 11 completely at a high speed.

More specifically, it is possible to change the voltage level of the switching transistors 11 and 12 back to the off-voltage before the voltage reaches the level at which leak current occurs at the gates of the switching transistors 11 and 12; and thus, it is possible to reduce the time T21 required for the voltage levels of the switching transistors 11 and 12 to change from the on-voltage into the threshold voltage Vgth, without significantly reducing the wiring time constant of the signal line 16 and the scanning lines 17 and 18.

Embodiment 3

In Embodiments 1 and 2, descriptions have been given of examples of the method of controlling the image display device. In Embodiment 3, a description is given of a case where occurrence of a residual image due to hysteresis characteristics of driving transistors is reduced by an appropriate wiring layout of the image display device in addition to Embodiments 1 and 2.

First, a description is given of problems caused in a case where a wiring layout is not properly provided, and then, a description is given of a wiring layout of the image display device according to Embodiment 3.

For example, an important function of the switching transistor 12 is to stably hold the gate voltage (VREF1) of the driving transistor 14 together with the electrostatic capacitor 13 without causing leak current in a reset period. Here, as described above, the reset period corresponds to a period from when the voltage level of the scanning line 17 is changed from HIGH (on-voltage) into LOW (off-voltage) (for example, time t2 shown in FIG. 3A) to when the voltage level of the scanning line 18 is changed from LOW into HIGH (for example, time t4 shown in FIG. 3A).

Furthermore, important functions of the switching transistor 11 are to stably hold the data voltage (Vdata) held by the electrostatic capacitor 13 with the electrostatic capacitor 23 without causing leak current, and to stably hold the data voltage (Vdata) held by the electrostatic capacitor 13 with the electrostatic capacitor 23 in a reset period.

However, the scanning line 17 is a control line fed from outside the display unit 6, and thus, is likely to pick up electrical noise from outside. Hence, if the potential of the scanning line 17 varies due to electrical noise during a write period from the end of the previous light emission period (for example, time t0 in FIG. 3A) to the start of the current light emission period (for example, time t4 in FIG. 3A), functions of the switching transistors 11 and 12 are prevented. More specifically, if the potential of the scanning line 17 varies due to electrical noise, and the variation affects the light-emitting pixel 10, the voltage value held by the electrostatic capacitor 13 or the voltage value held by the electrostatic capacitor 23 may also vary.

In particular, in the period from time t2 to time t4 shown in FIG. 3A, the electrostatic capacitor 13 or the electrostatic capacitor 23 is likely to be unstable, and is affected by the variation in the potential of the scanning line 17. Depending on the amount of variation, the switching transistors 11 and 12 are unintentionally turned on or off, resulting in reducing display quality such as causing crosstalk. Here, as described above, the period from time t2 to time t4 shown in FIG. 3A is a period during which control is performed such that the switching transistors 11 and 12 are off (non-conducting) via the scanning line 17, and the switching transistor 19 is off (non-conducting) via the scanning line 18.

Figure 12A:
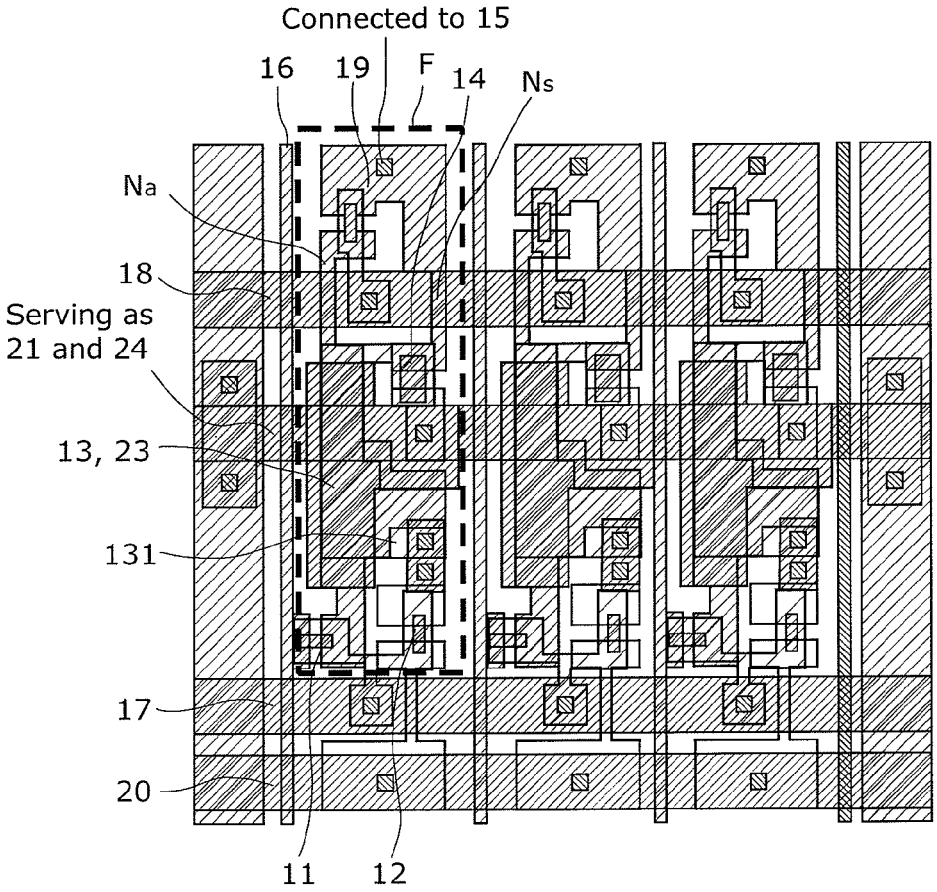
FIG. 12A is a diagram showing a wiring layout of light-emitting pixels according to Embodiment 3.
Figure 12B:
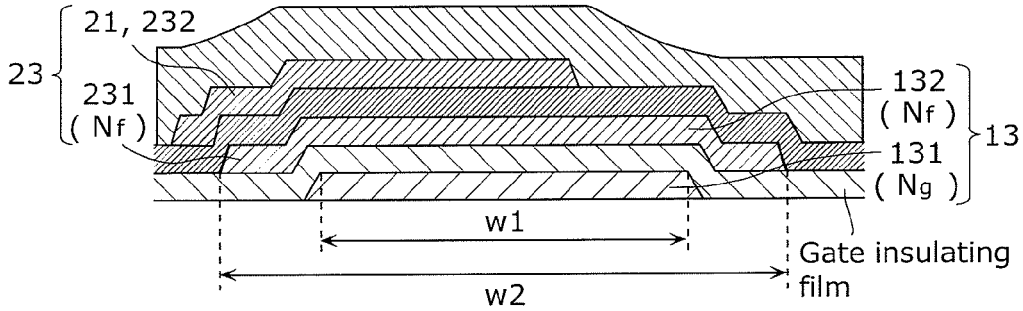
FIG. 12B is a diagram schematically showing an example of a cross-section of a region F in the wiring layout shown in FIG. 12A.
Figure 12C:
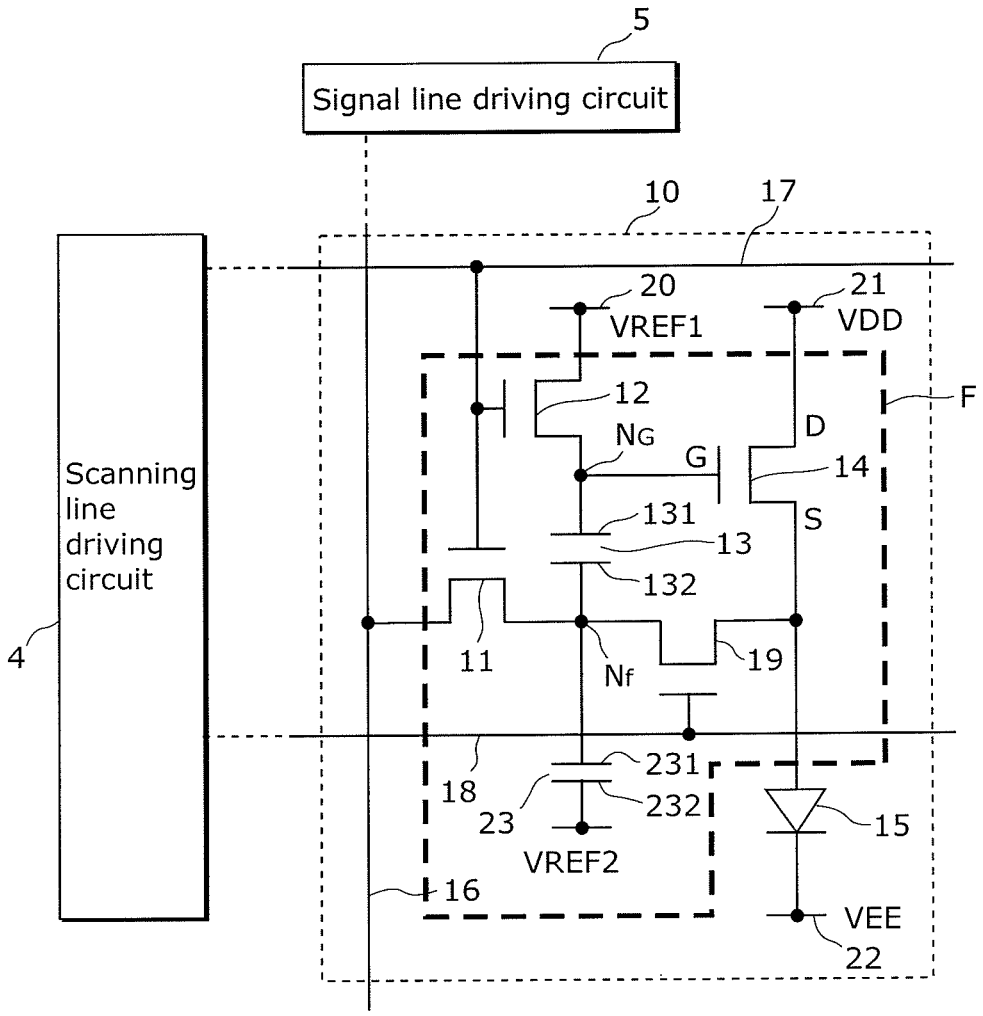
FIG. 12C is a diagram showing a circuit configuration of the wiring layout shown in FIG. 12A.

Thus, in Embodiment 3, as shown in FIG. 12A, the scanning line 17 is provided outside a pixel region F of the light-emitting pixel 10 shown in FIG. 12C. FIG. 12A is a diagram showing a wiring layout of light-emitting pixels 10 according to Embodiment 3. FIG. 12B and FIG. 12D to FIG. 12H each schematically shows an example of a cross-section of the region F in the wiring layout shown in FIG. 12A. FIG. 12C is a diagram of a circuit configuration of the wiring layout shown in FIG. 12A. FIG. 12C is the same as the circuit diagram shown in FIG. 2 except FIG. 12C indicates the pixel region F of the light-emitting pixel 10. In FIG. 12A to FIG. 12C, the elements similar to those in FIG. 2 are identified with the same referential numerals, and their detailed descriptions are not given.

As shown in FIG. 12A, in the light-emitting pixel 10, the switching transistor 11, the switching transistor 12, the electrostatic capacitor 13, the driving transistor 14, the switching transistor 19, and the electrostatic capacitor 23 are arranged (provided) in the pixel region F.

The reference power source line 20 is provided outside the pixel region F.

The scanning line 17 is provided outside the pixel region F. Accordingly, even if the potential of the scanning line 17 varies due to electrical noise or the like, it is possible to reduce influences of the variation on the pixel region F (crosstalk). As a result, it is possible to prevent the voltage held by the electrostatic capacitor 13 from varying.

Furthermore, as shown in FIG. 12A, the scanning line 17 is provided on a contact region for electrically connecting the reference power source line 20 and the switching transistor 12.

As shown in FIG. 12A, the scanning line 18 is fed into (laid out in) the pixel region F, and provided on or above a node Ns and a node Na. Here, the node Ns is for electrically connecting the source of the driving transistor 14 and the organic EL element 15. Furthermore, the node Na is for electrically connecting the switching transistor 11 and the switching transistor 19.

As shown in FIG. 12B, the electrostatic capacitor 13 and the electrostatic capacitor 23 are formed so as to be overlapped in different layers, in the vertical direction relative to the wiring layout of the light-emitting pixel 10. The electrode 132 of the electrostatic capacitor 13 and the electrode 231 of the electrostatic capacitor 23 are commonly used. Furthermore, a planarizing film 1330 is further formed above the second insulating film 1320 on the electrostatic capacitor 13 and the electrostatic capacitor 23. A gate insulating film 1310 is formed between the electrode 132 and the electrode 131 of the electrostatic capacitor 13. The second insulating film 1320 is formed between the electrode 232 and the electrode 231 of the electrostatic capacitor 23.

The electrode 232 of the electrostatic capacitor 23 servers a part of the positive power source line 21.

In other words, the electrode 232 of the electrostatic capacitor 23, the node Nf where the switching transistor 11 and the switching transistor 19 are connected, and the node Ng which extends the gate of the driving transistor 14 are overlapped in this order in the vertical direction relative to the wiring layout surface. Here, the node Nf is a part of the node Na, and corresponds to the electrode layer which serves as the electrode 132 of the electrostatic capacitor 13 and also as the electrode 231 of the electrostatic capacitor 23. Similarly, the node Ng corresponds to the electrode layer which serves as the electrode 131 of the electrostatic capacitor 13 and also as the gate of the driving transistor 14. Furthermore, the electrode 232 of the electrostatic capacitor 23 also serves as a part of the positive power source line 21. By overlapping the electrostatic capacitor 13 and the electrostatic capacitor 23 in the vertical direction relative to the wiring layout surface in such a manner, it is possible to reduce the element placement region.

Furthermore, as shown in FIG. 12B, the width w1 of the electrode 131 of the electrostatic capacitor 13 is smaller than the width w2 of the electrode 231 of the electrostatic capacitor 23.

In other words, in the region where the electrode 232 of the electrostatic capacitor 23, the node Nf where the switching transistors 11 and 19 are connected, and the node Ng which extends the gate of the driving transistor 14 are overlapped in this order, the width of the node Ng is smaller than the width of the node Nf.

According to such a structure, the positive power source line 21 and the node Ng are overlapped in the vertical direction relative to the wiring layout surface, the capacitance between the positive power source line 21 and the node Nf corresponds to the capacitance of the electrostatic capacitor 23, the capacitance between the node Nf and the node Ng corresponds to the electrostatic capacitor 13. Accordingly, the node Ng connected to the gate electrode which controls the driving transistor 14 can be protected from electrostatic noise, leading to stabilization.

With such a wiring layout, it is possible to reduce occurrence of parasitic capacitance at unnecessary locations.

The example of the cross-section of the region F of the wiring layout shown in FIG. 12A is not limited to FIG. 12B. It may be as in FIG. 12C to FIG. 12H.

Figure 12D:
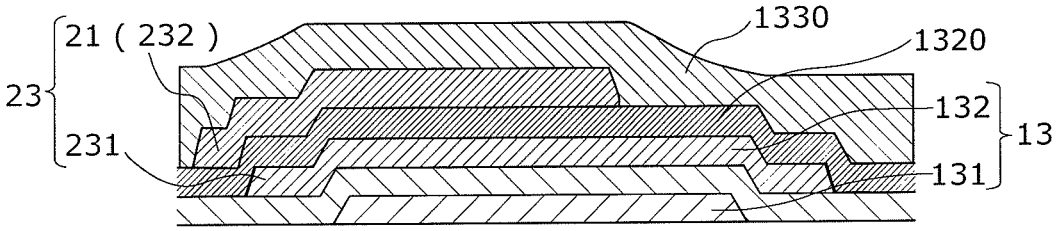
FIG. 12D is a diagram schematically showing another example of a cross-section of the region F in the wiring layout shown in FIG. 12A.

For example, as shown in FIG. 12D, it may be that the wiring layer, which is immediately above the second insulating film 1320 and which is included in the electrostatic capacitor 23, is thicker than the electrode 131 or the electrode 132 of the electrostatic capacitor 13. More specifically, the positive power source line 21 and the scanning line which are formed in the wiring layer immediately above the second insulating film 1320 may be thicker than the electrode 131 or the electrode 132 of the electrostatic capacitor 13.

Accordingly, it is possible to reduce wiring resistance of the positive power source line 21 or the scanning line; and thus, it is possible to further stabilize display quality by reducing voltage drop of the positive power source line 21, supplying stable power source to the driving transistor 14, or reducing wiring time constant of the scanning line.

Figure 12E:
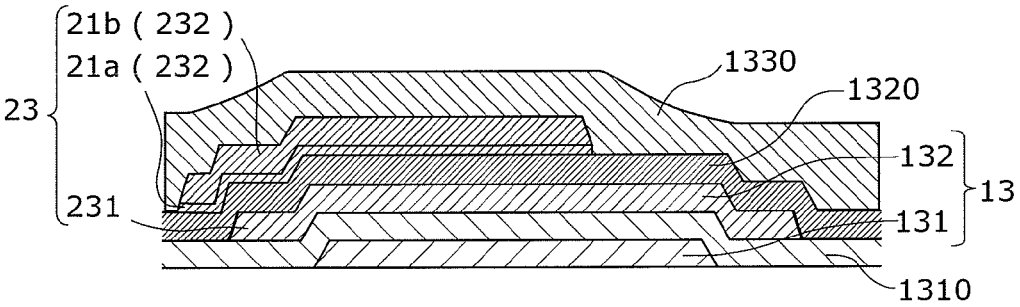
FIG. 12E is a diagram schematically showing another example of a cross-section of the region F in the wiring layout shown in FIG. 12A.

Furthermore, for example, as shown in FIG. 12E, it may be that the wiring layer immediately above the second insulating film 1320 includes at least two layers, and at least one of the layers forms the electrode 232 of the electrostatic capacitor 23. More specifically, as to the positive power source line 21 which serves as the electrode 232 of the electrostatic capacitor 23 and also serves as a part of the electrode 232 of the electrostatic capacitor 23, the positive power source line 21 (the electrode 232 of the electrostatic capacitor 23) may have a double layer structure including a lower layer 21*a* and an upper layer 21*b*.

Here, for example, the lower layer 21*a* may comprise indium tin oxide (ITO), and the upper layer 21*b* may comprise aluminum (Al), copper (Cu) or alloy including Al and Cu.

Accordingly, in the similar manner as above, the wiring resistance of the first power source line and the scanning line can be reduced.

Figure 12F:
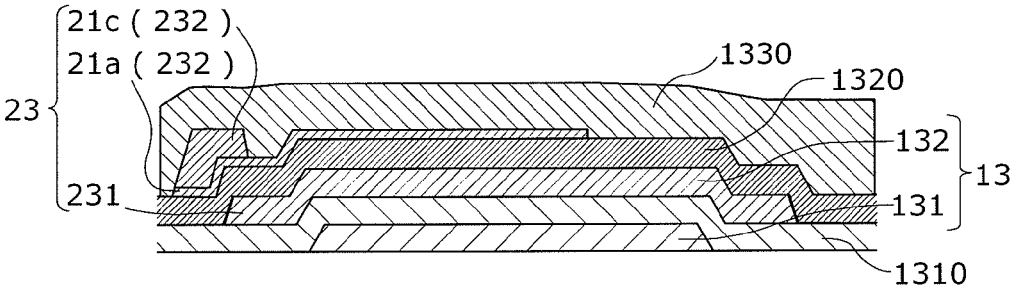
FIG. 12F is a diagram schematically showing another example of a cross-section of the region F in the wiring layout shown in FIG. 12A.

Furthermore, as shown in FIG. 12F, it may be that the wiring layer immediately above the second insulating film 1320 includes a plurality of layers, and the uppermost layer is thickest and the layers excluding the uppermost layer forms the electrode 232 of the electrostatic capacitor 23. More specifically, the wiring layer immediately above the second insulating film 1320 includes a plurality of layers, the uppermost layer of the wiring layer is thickest, and the uppermost layer is not formed in the region of the electrostatic capacitor 23. In other words, the upper layer 21*c* may be formed only on a part of the lower layer 21*a*. According to such a structure, the lower layer 21*a* serves as the electrode 232 of the electrostatic capacitor 23, thereby fulfilling the function of the electrostatic capacitor 23.

With this, the positive power source line 21 and the scanning line are formed including the uppermost layer of the wiring layer immediately above the second insulating film 1320. As a result, it is possible to reduce wiring resistance and also to reduce the thickness of the electrode 232 of the electrostatic capacitor 23. In addition, it is possible to thin the region where the electrostatic capacitor 13 and the electrostatic capacitor 23 are overlapped, thereby reducing the difference in height between the region where the electrostatic capacitor 13 and the electrostatic capacitor 23 are overlapped and the region where no wiring pattern exists. Accordingly, it is possible to reduce wiring resistance of the positive power source line 21 and the scanning line 17, and also to improve flatness of the planarizing film 1320 placed above the pixel region F.

Figure 12G:
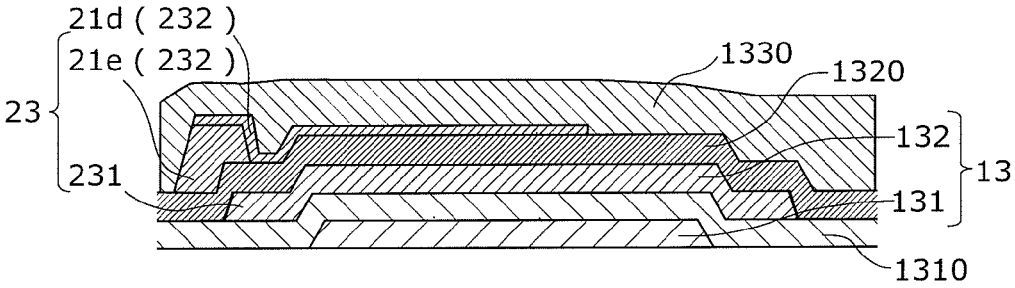
FIG. 12G is a diagram schematically showing another example of a cross-section of the region F in the wiring layout shown in FIG. 12A.

Furthermore, for example, as shown in FIG. 12G, it may be that the wiring layer immediately above the second insulating film 1320 includes a plurality of layers, the lowermost layer is thickest, and the layers excluding the lowermost layer forms the electrode 232 of the electrostatic capacitor 23.

More specifically, the wiring layer immediately above the second insulating film 1320 includes a plurality of layers, the lowermost layer of the positive power source line 21 or the scanning line is thickest, and the lowermost layer of the positive power source line 21 is not formed in the region of the electrostatic capacitor 23.

According to this structure, it is possible to reduce wiring resistance of the positive power source line 21 and the scanning line 17, reduce the thickness of the second electrode of the second capacitor, and reduce the thickness of the region where the electrostatic capacitor 13 and the electrostatic capacitor 23 are overlapped, thereby reducing the difference in height between the region where the electrostatic capacitor 13 and the electrostatic capacitor 23 are overlapped and the region where no wiring pattern exists. Accordingly, it is possible to reduce wiring resistance of the positive power source line 21, and also to improve flatness of the planarizing film 1320 placed above the pixel region F.

Note that the upper layer 21*c* and the lower layer 21*a* in FIG. 12F may comprise the same material, and the upper layer 21*d* and the lower layer 21*e* in FIG. 12G may comprise the same material.

Figure 12H:
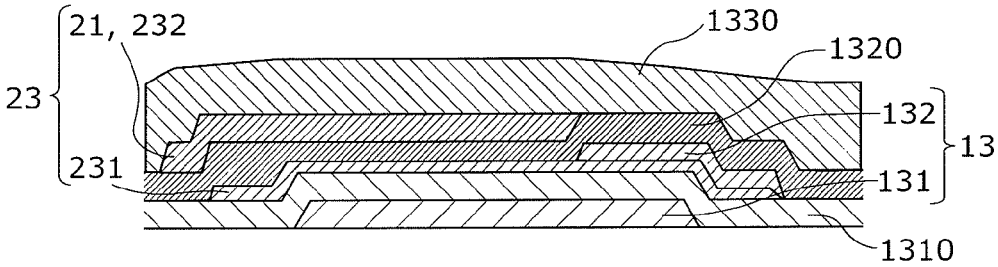
FIG. 12H is a diagram schematically showing another example of a cross-section of the region F in the wiring layout shown in FIG. 12A.

In the similar manner, the configuration in which the thickness of the electrode in the region where the electrostatic capacitor 13 and the electrostatic capacitor 23 are overlapped is reduced, may be suitably adopted or combined to the electrode 231 (132) of the electrostatic capacitor 23 or the electrode 131 of the electrostatic capacitor 13. Accordingly, it is possible to reduce the thickness of the region where the electrostatic capacitor 13 and the electrostatic capacitor 23 are overlapped. FIG. 12H shows a specific example. FIG. 12H shows an example where the thickness of the electrode 132 of the electrostatic capacitor 13 and the electrode 231 of the electrostatic capacitor 23 are reduced in the region where the electrostatic capacitor 13 and the electrostatic capacitor 23 are overlapped. Of course, the pattern of the suitably adopted combination is not limited to the specific example. It is needless to say that various combinations are possible, such as the thickness of the electrode 131 of the electrostatic capacitor 13 is reduced.

Any of such configuration allows further reduction of the difference in height with the region where no wiring pattern exists.

As described, by appropriately providing the wiring layout of the image display device in addition to Embodiments 1 and 2, it is possible not only to reduce occurrence of a residue image due to hysteresis characteristics of the driving transistor, but also to stably hold the gate voltage of the driving transistor 14 and the voltage held by the electrostatic capacitor 13 and the electrostatic capacitor 23.

One or more exemplary embodiments or features disclosed herein provide an image display device which reduces occurrence of residual images due to hysteresis characteristics of driving transistors, with simple pixel circuits.

In the above embodiments, the driving transistor 14 is an n-type transistor, and the cathode of the organic EL element 15 is connected to the common power source line. However, the same advantageous effects as in each embodiment can be obtained by an image display device in which the driving transistor 14 is a p-type transistor, and the anode of the organic EL element 15 is connected to the common power source line.

Figure 13:
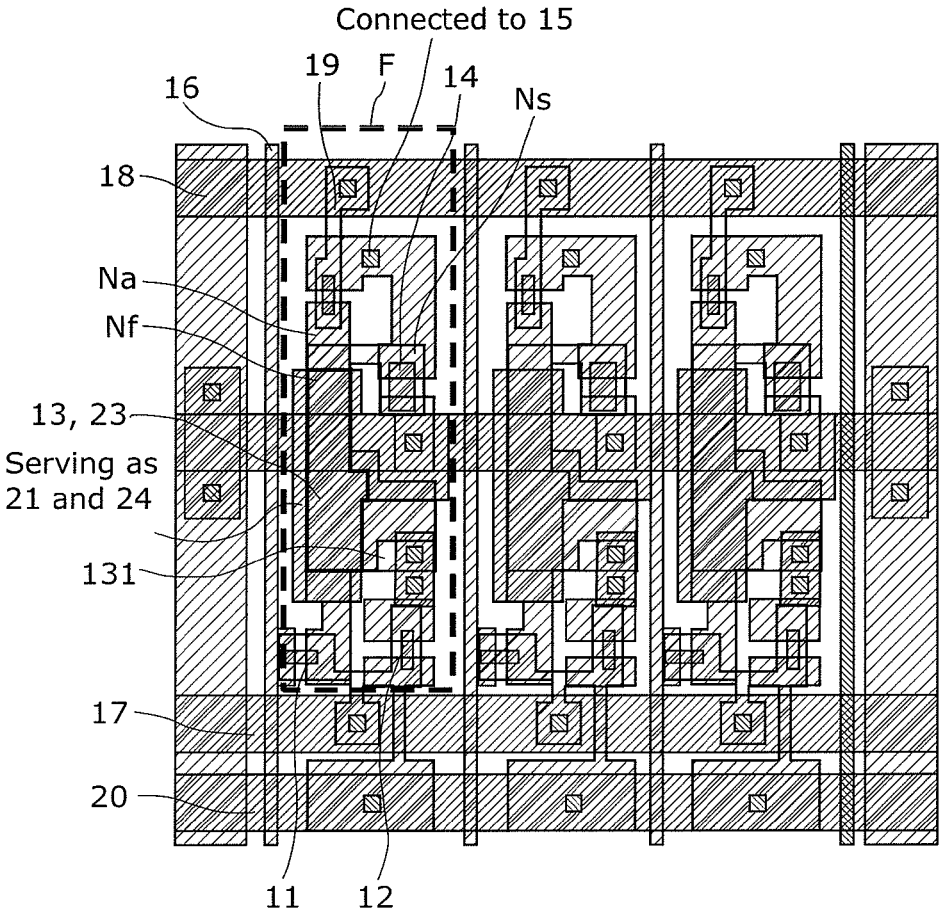
FIG. 13 is a diagram showing another example of wiring layout of light-emitting pixels according to Embodiment 3.

Furthermore, in Embodiment 3, as shown in FIG. 12A, the scanning line 17 is provided outside the pixel region F of the light-emitting pixel 10 shown in FIG. 12G; however, the layout is not limited to this example. As shown in FIG. 13, the scanning line 18 instead of the scanning line 17 may be provided outside the pixel region F of the light-emitting pixel 10.

Figure 14:
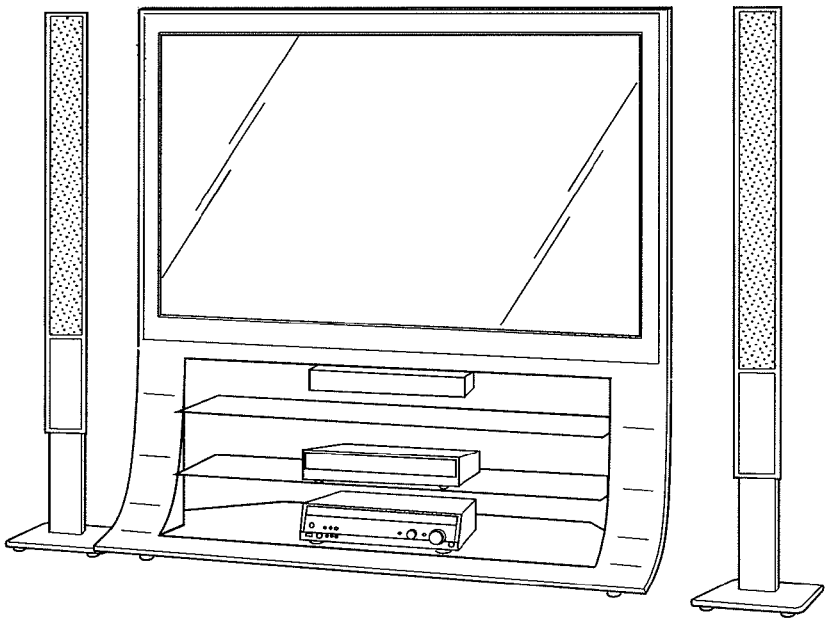
FIG. 14 is an external view of a thin flat TV including an image display device according to the present disclosure.
Figure 15:
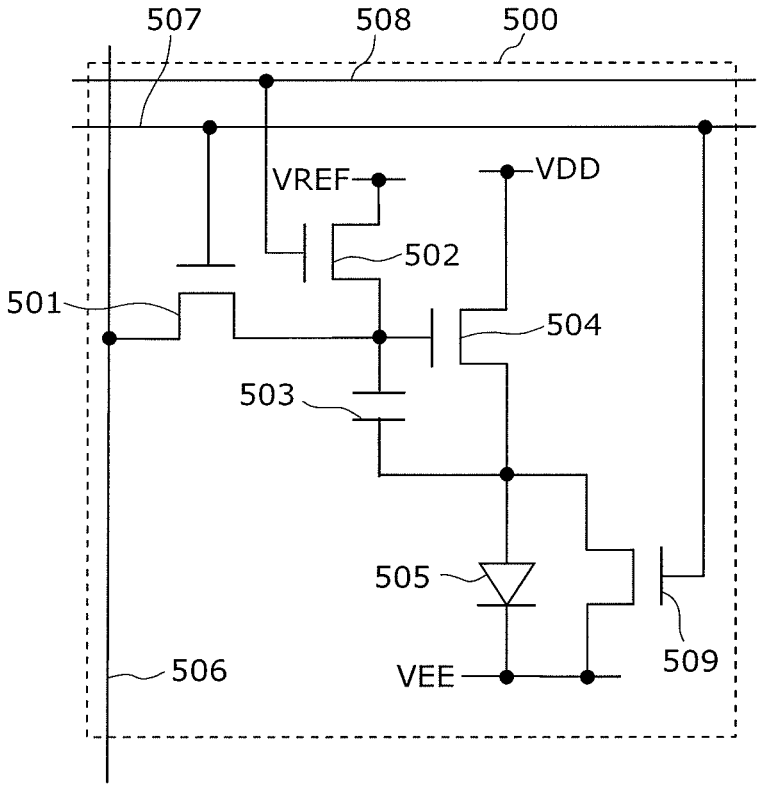
FIG. 15 is a circuit configuration diagram of a pixel unit in a conventional organic EL display device according to PTL1.

In addition, a display device according to the present disclosure is embedded, for example, in a thin flat TV as shown in FIG. 14. Embedding an image display device according to the present disclosure makes it possible to achieve a thin flat TV capable of achieving accurate image display reflecting a video signal.

The herein disclosed subject matter is to be considered descriptive and illustrative only, and the appended Claims are of a scope intended to cover and encompass not only the particular embodiment(s) disclosed, but also equivalent structures, methods, and/or uses.

INDUSTRIAL APPLICABILITY

An image display device according to one or more exemplary embodiments disclosed herein is useful, in particular, for an active organic EL flat panel display in which luminance is changed by controlling light emission intensity of pixels using pixel signal current.

The invention claimed is:

1. An image display device comprising:

a light-emitting element;

a first capacitor which holds a voltage;

a driving transistor having a gate electrode connected to a first electrode of the first capacitor, and a source electrode connected to a first electrode of the light-emitting element, the driving transistor causing the light-emitting element to emit light by applying, to the light-emitting element, a drain current corresponding to the voltage held by the first capacitor;

a second capacitor having a first electrode connected to a second electrode of the first capacitor;

a first power source line connected to a drain electrode of the driving transistor, for determining a potential of the drain electrode of the driving transistor;

a second power source line connected to a second electrode of the light-emitting element, for determining a potential of the second electrode of the light-emitting element;

a third power source line connected to the first electrode of the first capacitor, for supplying a first reference voltage defining a voltage value of the first electrode of the first capacitor;

a fourth power source line connected to a second electrode of the second capacitor, for supplying a second reference voltage defining a voltage value of the second electrode of the second capacitor;

a data line for supplying a signal voltage to the second electrode of the first capacitor;

a first switching element provided between the first electrode of the first capacitor and the third power source line, the first switching element setting the first reference voltage to the first electrode of the first capacitor;

a second switching element having two terminals one of which is electrically connected to the data line and the other of which is electrically connected to the second electrode of the first capacitor, the second switching element switching between a conducting state and a non-conducting state between the data line and the second electrode of the first capacitor;

a third switching element provided between the first electrode of the light-emitting element and the second electrode of the first capacitor, the third switching element switching between a conducting state and a non-conducting state between the first electrode of the light-emitting element and the second electrode of the first capacitor;

a driving circuit which controls the first switching element, the second switching element, and the third switching element;

a first scanning line connected to the first switching element, the second switching element, and the driving circuit; and a second scanning line connected to the third switching element and the driving circuit, wherein, at a start of a reset period in a non-light-emitting period during which the third switching element is non-conducting, the driving circuit starts (i) setting a data voltage from the data line to the second electrode of the first capacitor, (ii) setting the first reference voltage from the third power source line to the first electrode of the first capacitor and the gate electrode of the driving transistor, and (iii) setting a fixed voltage corresponding to a potential of the second power source line to the source electrode of the driving transistor, the start of the reset period being a time at which the first switching element and the second switching element are made conducting by applying an on-voltage to the first scanning line;

in the non-light-emitting period after making the first switching element and the second switching element non-conducting by applying an off-voltage to the first scanning line, the fixed voltage corresponding to the potential of the second power source line is set to the source electrode of the driving transistor; and in a light-emitting period, the driving circuit causes the light-emitting element to emit light, by applying a potential difference between the first electrode and the second electrode of the first capacitor, between the gate electrode and the source electrode of the driving transistor to cause a current to flow between the drain electrode and the source electrode of the driving transistor according to a potential difference between the gate electrode and the source electrode of the driving transistor, the light-emitting period being a period during which the first switching element and the second switching element are non-conducting and the third switching element is conducting made via the second scanning line.

2. The image display device according to claim 1,
wherein, in the non-light-emitting period, a reverse bias is applied to the driving transistor by applying the fixed voltage corresponding to the potential of the second power source line and the first reference voltage.

3. The image display device according to claim 1,
wherein a potential difference between the second power source line and the first electrode of the first capacitor to which the first reference voltage is set is less than or equal to a sum of an absolute value of a threshold voltage of the driving transistor and a threshold voltage for light emission of the light-emitting element.

4. The image display device according to claim 1,
wherein the fixed voltage corresponding to the first reference voltage is a potential determined based on electrical characteristics of the driving transistor, electric characteristics of the light-emitting element, and the first reference voltage.

5. The image display device according to claim 1,
wherein, when changing the first switching element and the second switching element from conducting into non-conducting via the first scanning line, the driving circuit applies an overdrive voltage that is a voltage lower than the off-voltage to the gate electrode of the first switching element and the gate electrode of the second switching element, and then applies the off-voltage to the gate electrode of the first switching element and the gate electrode of the second switching element.

6. The image display device according to claim 5,
wherein a length of a period during which the overdrive voltage is applied to the gate electrode of the first switching element and the gate electrode of the second switching element is shorter than a length of a period during which the on-voltage is applied to the gate electrode of the first switching element and the gate electrode of the second switching element.

7. The image display device according to claim 1,
wherein the non-light-emitting period is 25 percent or more of a single frame period that is a period from when the first switching element and the second switching element are made conducting to when the first switching element and the second switching element are made conducting in a subsequent non-luminescence period.

8. The image display device according to claim 7,
wherein the driving transistor includes a semiconductor layer which includes a crystalline silicon layer obtained by laser annealing an amorphous silicon film for crystallization.

9. The image display device according to claim 1,
wherein the first scanning line is provided outside a single pixel region which includes the first capacitor, the driving transistor, the second capacitor, the first switching element, the second switching element, and the third switching element.

10. The image display device according to claim 9,
wherein the second scanning line passes within the single pixel region.

11. The image display device according to claim 9,
wherein the third power source line is provided outside the single pixel region, and
the first scanning line is provided on a contact region which is for electrically connecting the third power source line and the driving transistor.

12. The image display device according to claim 11,
wherein the second scanning line is provided on a node where the source electrode of the driving transistor and the luminescence element are connected and a node where the second switching element and the third switching element are connected.

13. The image display device according to claim 9,
wherein the second electrode of the second capacitor, a first node, and a second node are overlapped in this order in a vertical direction relative to the first power source line, the first node extending a source electrode of the second switching element and a source electrode of the third switching element, and the second node extending the gate electrode of the driving transistor.

14. The image display device according to claim 13,
wherein, in a region where the second electrode of the second capacitor, the first node, and the second node are overlapped in this order in the vertical direction, the second node has a width smaller than a width of the first node.

15. The image display device according to claim 14,
wherein the first capacitor includes the second node, a first insulating film, and the first node, and
the second capacitor includes the second electrode, a second insulating film, and the first node.

16. The image display device according to claim 15,
wherein a wiring layer immediately above the second insulating film is thicker than the first electrode or the second electrode of the first capacitor.

17. The image display device according to claim 15,
wherein a wiring layer immediately above the second insulating film includes at least two layers, and
at least one of the at least two layers forms the second electrode of the second capacitor.

18. The image display device according to claim 15,
wherein a wiring layer immediately above the second insulating film includes a plurality of layers,
an uppermost layer of the wiring layer is thickest among the plurality of layers, and
the plurality of layers excluding the uppermost layer form the second electrode of the second capacitor.

19. The image display device according to claim 15,
wherein a wiring layer immediately above the second insulating film includes a plurality of layers,
a lowermost layer of the wiring layer is thickest among the plurality of layers, and
the plurality of layers excluding the lowermost layer form the second electrode of the second capacitor.

20. The image display device according to claim 9,
wherein the second electrode of the second capacitor is included in a part of one of the first power source line, the second power source line and the third power source line.

21. The image display device according to claim 9,
wherein the second electrode of the second capacitor is connected to one of the first power source line, the second power source line, the third power source line, the source of the driving transistor, and the second scanning line.

22. The image display device according to claim 1, wherein the second scanning line is provided outside a single pixel region which includes the first capacitor, the driving transistor, the second capacitor, the first switching element, the second switching element, and the third switching element.

* * * * *